US011898796B1

(12) United States Patent
Anthony

(10) Patent No.: US 11,898,796 B1
(45) Date of Patent: Feb. 13, 2024

(54) HUMIDIFICATION AND DEHYMIDIFICATION PROCESS AND APPARATUS FOR CHILLING BEVERAGES AND OTHER FOOD PRODUCTS AND PROCESS OF MANUFACTURE

(71) Applicant: Michael Mark Anthony, Hohenwald, TN (US)

(72) Inventor: Michael Mark Anthony, Hohenwald, TN (US)

( * ) Notice: Subject to any disclaimer, the term of this patent is extended or adjusted under 35 U.S.C. 154(b) by 561 days.

(21) Appl. No.: 16/350,484

(22) Filed: Nov. 20, 2018

Related U.S. Application Data

(63) Continuation-in-part of application No. 15/932,812, filed on Apr. 30, 2018, and a continuation-in-part of application No. 14/120,540, filed on May 30, 2014, now Pat. No. 10,076,723.

(51) Int. Cl.
*F25D 5/02* (2006.01)

(52) U.S. Cl.
CPC ..... *F25D 5/02* (2013.01); *F25D 2331/805* (2013.01)

(58) Field of Classification Search
CPC ..... F25D 5/02
See application file for complete search history.

(56) References Cited

U.S. PATENT DOCUMENTS

| | | | | |
|---|---|---|---|---|
| 2,300,793 | A | 11/1942 | Martin | |
| 3,229,478 | A | 1/1966 | Alonso | |
| 3,494,143 | A | 2/1970 | Barnett et al. | |
| 3,970,068 | A | 7/1976 | Sato | |
| 4,584,848 | A | 4/1986 | Barnett | |
| 4,669,273 | A | 6/1987 | Fischer et al. | |
| 4,688,395 | A | 8/1987 | Holcomb | |
| 4,753,085 | A | 6/1988 | Labrousse | |
| 4,928,495 | A | 5/1990 | Siegel | |
| 4,993,237 | A | 2/1991 | Bond et al. | |
| 5,626,022 | A | 5/1997 | Scudder et al. | |
| 6,103,280 | A * | 8/2000 | Molzahn | A23G 9/00 426/109 |
| 6,141,970 | A | 11/2000 | Molzahn et al. | |
| 6,170,283 | B1 | 1/2001 | Anthony | |
| 7,107,783 | B2 | 9/2006 | Smolko et al. | |
| 7,117,684 | B2 | 10/2006 | Scudder et al. | |
| 10,018,395 | B2 | 7/2018 | Boyd | |
| 2011/0271692 | A1 * | 11/2011 | Rasmussen | F25D 5/02 62/4 |

OTHER PUBLICATIONS

Tom Vanderbilt, Design—Pop Art—The brilliant redesign of the soda can tab, Sep. 24, 2012, The Slate Group LLC, https://slate.com/ (Year: 2012).*

* cited by examiner

*Primary Examiner* — Nael N Babaa
(74) *Attorney, Agent, or Firm* — Frank L. Kubler

(57) ABSTRACT

A novel self-cooling food product container apparatus (10) and a process for manufacturing the same is disclosed. A self-cooling food product container (20) combined with a substantive vapor transport system producing a humidification cooling process for cooling food and beverage products P. Methods of assembling and operating the apparatus (10) are also provided.

11 Claims, 21 Drawing Sheets

HUMIDIFICATION AND DEHYMIDIFICATION PROCESS AND APPARATUS FOR CHILLING BEVERAGES AND OTHER FOOD PRODUCTS AND PROCESS OF MANUFACTURE

Filing History

This application is a continuation-in-part of application Ser. No. 15/932,812 filed on Apr. 30, 2018, which is a divisional of application Ser. No. 14/120,540, filed on May 30, 2014.

BACKGROUND OF THE INVENTION

1. Field of the Invention

The present novel invention relates generally to the art of cooling food and beverage containers and to processes for manufacturing such containers. More specifically the present invention relates to an apparatus for cooling a food product such as a beverage, means and methods of cooling said containers with said apparatus, including methods of assembling and operating said apparatus. The terms "beverage," "food," "food products" and "container contents" are considered as equivalent for the purposes of this application and used interchangeably. The term "food product container" refers to any sealed and openable storage means for a food product meant for consumption.

2. Description of the Prior Art

There previously have been many self-cooling food product container devices for cooling the container contents in the form of a beverage or other food beverage food product container. These devices sometimes use flexible and deformable receptacles or rigid receptacle sides to store a refrigerant for phase change cooling. Some prior art devices use desiccants with a vacuum V activated to evaporate water at low pressure and absorb vapor into a desiccant. Other prior devices use refrigerants stored between pressure vessels in liquid phase to achieve the cooling by causing a phase change of refrigerants from a liquid to a gaseous state. The present inventor has invented a variety of such devices and methods of manufacturing them. Several prior self-cooling food product container technologies rely on the evaporation of a refrigerant from the liquid phase to the gaseous phase. Some rely on desiccants only. Desiccant technologies rely the thermodynamic potential of a desiccant to absorb water from a gaseous phase into the desiccant to effectuate the evaporation of water in a vacuum V. These earlier inventions do not satisfy all the needs of the beverage industry and they do not use electromotive heat transport means to cool a beverage. In fact, they are so structurally different from the present invention, that one skilled in the art cannot possibly transcend from the prior art to the present invention without an inventive process. In an effort to seek a cost effective and functioning apparatus for self-cooling a beverage food product container, the present inventor has done a variety of experiments to arrive at the present novel method. The following issues have kept the cost effective commercialization of all prior art devices prohibitively high.

Prior art that uses liquefied refrigerants fail to address the real issues of manufacturing and beverage plant operations that are crucial for the success of a self-cooling food product container program. Some such prior art designs require pressurized food product containers to store liquid refrigerants. For example, U.S. Pat. No. 4,584,848 to inventor Eugene R. Barnett, uses a double chamber formed or drawn from a slug of metal to store pressurized gases and release them using complicated valves involving a spring and a lance to pierce and allow the pressurized gases to escape and cool by evaporation. In line 61 page 1, the inventor states "The outer chamber has a relatively thin wall, and the inner chamber has a relatively thicker wall". The inventor also sites a spring and a lance mechanism and in fact the inventor recites that the pressure of the gases used by the apparatus is high by reciting on line 54 and 55 of page 2 " . . . the coolant emerges from the high pressure in the inner chamber 11*b*". Such a device is expensive to make and the cost of springs alone can deter the commercial viability of such devices.

The only liquid refrigerants that can be stored between commercially viable pressure canisters are HFCS, CFCS, hydrocarbons, ethers, and other highly flammable low-pressure gases. These gases are not commercially viable and have led to difficulty in implementation of such technologies. Most commercial refrigerants are ozone depleting and global warming and as such have been banned by the EPA in the USA and other governing bodies for direct release into the atmosphere as products of a self-cooling food product container. The EPA has mandated that no refrigerant be used in a self-cooling food product container except $CO_2$ and if used, the design must be safe. Refrigerants currently available cause both global warming and ozone depletion. Generally, they are common refrigerants such as 134*a* and 152*a*. In some cases, flammable gases such as butane and propane have been tried but the risk factors are high for several reasons. Firstly, the use of such technologies in a closed room can cause a variety of effects including asphyxiation, poisoning and so on. Second the flammability of some refrigerants limits the number of food product containers that can be opened in a closed environment such as during parties or in a vehicle. The present inventor has several patents on these prior technologies, has experimented with several of these technologies and has found them to be unsuitable for commercial viability. Further, the cost of refrigerants is very prohibitive and the cost of cooling cannot justify the use of refrigerant gases.

As another example by the present inventor, U.S. Pat. No. 6,170,283 uses an expandable receptacle to store pressurized liquefied gases that can be released to cool a beverage by evaporation of said liquefied gases. However, to reduce costs, the inventor resorts to attaching the receptacle to the rim of the beverage container to separate the beverage from the liquefied gases. On line 53 page 6, the inventor states, " . . . where liquefied refrigerant 28 is charged into receptacle 30 . . . ". The intent of this patent was to reduce costs by creating a liquefied storage system that relies of the container itself to withstand the pressure of the liquefied refrigerants. This however requires breakable portions of the receptacle that can also break unintentionally and permitting the refrigerant to contaminate the beverage.

A similar situation is presented by U.S. Pat. No. 3,494,143 to E. R. Barnett et al, where a metal container is jointly crimped with the beverage container lid to generate a double chamber for the beverage and the refrigerants. The inventor resorts to a puncturing tool to activate the apparatus for cooling. On Line 14 page 3, the inventor states, "The puncturing tool 54 is shown as a cone-shaped penetrator or piercing point 56 carried as shown by the lower portion of leaf 58 of a formed piece of resilient sheet-stock, . . . ". Again, the expense of just forming such a part is prohibitive to the commercialization of a self-cooling container since it involves special manufacturing processes that exceed the cost of even the container itself.

In U.S. Pat. No. 4,669,273, Fischer et al invented a coiled tube insert to cool a beverage within a beverage container by releasing a pressurized liquid refrigerant from the coiled tube to an evaporator to chill the beverage within the container. On line, 32 page 2, the inventor recites, "The coiled tube assembly 15 comprises thin walled coiled tube 15*a* . . . ". The cost of a coiled tube that can hold pressurized refrigerants at even carbonation pressures is prohibitive. For example, a ¼ " diameter commercial aluminum thin-walled tube can cost about $1.00/foot, and since the coil described by the inventor must hold at least 4 oz of a refrigerant to effectively cool a 12 oz beverage, one would need at least a coil of length of about 129 inches, or about 10 ft. This patent also is plagued with commercial issues since the manufacture of the coiled tube is expensive and requires materials and processes costing far more that it would cost to refrigerate the beverage in a refrigerator over an average period of time of storage before consumption.

Robert R. Holcomb of Alabama revealed in his US patent number 468,8395, a self-contained cooling device for use in a container that includes a reservoir containing a highly pressurized fluid such as $CO_2$. On line 61, page 2, the inventor recites, "The reservoir is preferably pressurized with carbondioxide." Carbondioxide has a liquefaction pressure of over 800 psi. Such pressures cannot be easily contained in pressure chambers with diameters of 1" or more without specialized designs and thick walled materials. In fact, the cone design the inventor manifests as operable is counter-intuitive, since it has a pressure profile that changes as its diameter changes along the cone axis. Wall thickness of at least 0.125" are required by DOT regulations to transport $CO_2$ in commercial pressure canisters. This is far removed from the present invention which teaches the use of extremely low pressure chambers made from bag-like materials to achieve better cooling.

The inventor further teaches that the refrigerant reservoir is secured to the inside of the container to form an expansion chamber between the reservoir and the container. And a tube communicates with the reservoir and extends into the expansion chamber, the tube normally being closed to prevent escape of pressurized fluid from the reservoir. When it is desired to cool the contents of the container the tube is opened so that pressurized fluid from the reservoir expands into the expansion chamber thereby cooling the expansion chamber, reservoir, and contents of the container. This invention also uses sophisticated spring loaded actuators to release the refrigerant for cooling. The cost of such springs are definitely further evidence of the prohibitive nature of such inventions to the commercialization of a self-cooling container.

Further examples of inventions that use pressurized gases are found in U.S. Pat. Nos. 3,494,143, 3,088,680, 4,319,464, 3,241,731, 8,033,132, 4,319,464, 3,852,975, 4,669,273, 3,494,141, 3,520,148, 3,636,726, 3,759,060, 3,597,937, 4,584,848, 3,417,573, 3,468,452, 654,174, 1,971,364, 5,063, 754, 3,919,856, 4,640,102, 3,881,321, 4,656,838, 3,862,548, 4,679,407, 4,688,395, 3,842,617, 3,803,867, 6,170,283, 5,704,222 and many others.

Prior art that uses cryogenic refrigerants such as $CO_2$ fail to address the real issues of manufacturing and beverage plant operations that are crucial for the success of a self-cooling food product container program. All such prior art designs require very highly pressurized food product containers to store the cryogenic refrigerants. Some technologies that promise to use $CO_2$ have implemented carbon traps such as activated carbon, and fullerene nanotubes to store the refrigerants in a carbon matrix. These added desiccants and activated carbon storage systems are too expensive to implement commercially and further, the carbon and other absorptive media that lowers the pressure can contaminate the beverage products. Therefore, there is a need to reduce the quantities of such chemicals needed. Cryogenic self-cooling food product containers require the use of very high pressure vessels, and cryogenic gases such as $CO_2$, and they also require expensive containers made from high pressure bearing materials such as aluminum, steel, or fiber-glass. They are essentially dangerous, since the pressures involved are generally of the order of 600 psi or more.

Desiccant-based self-cooling food product containers require the desiccant to be stored in a an evacuated chamber separated fluidly from water stored in a separate chamber. When the vacuum is released between the two compartments, water vapor is pulled into the vacuum and then absorbed by the desiccant and heat of evaporation is taken from the cooled item and transported to condense in the desiccant. The heat taken by the evaporated water heats up the desiccant and must not be permitted to interact with the beverage, otherwise it would reheat the beverage again. It is very difficult to maintain for a long period a true vacuum in chamber adjacent to a water containing chamber since the permeability of the barrier used to separate the desiccant chamber from the water chamber contributes to the efficiency of cooling, and the thicker the barrier required the more expensive it becomes to manufacture. Further, the valves and activation devices used by prior art using a desiccant cooling means require stiff pins, knives, and so on. Further, the vacuum must be maintained for a long period of storage time and often fails. Migration of moisture into the desiccant can destroy the cooling capacity of such devices. Further, it is extremely difficult to handle desiccant crystals the way prior art designs are implemented, and powders in a mass-manufacturing environment where the desiccant has to be maintained moisture free and contaminant-free inside a pressurized beverage food product container is extremely difficult to realize. Thus a better technology is needed to handle these desiccants separately from the food product container. Further, the heat absorption potential of desiccants reduces as the vacuum is released and evaporation starts and the process becomes inefficient by itself and becomes limited to the amount of desiccant used.

The problems presented by vacuums, including difficulties in creating and maintaining them and the lack of efficiency have been encountered in other fields as well. An early example can be found in the evolution of Thomas A. Edison's light bulb. His first practical incandescent lamp, for which he received a patent in 1879, included a carbonized bamboo filament contained within an evacuated glass bulb. Although it arguably propelled the world into a new era, it was initially highly inefficient. Then in 1904, European inventors replaced the carbonized bamboo filament with tungsten, and in 1913 it was discovered that replacing the vacuum within the bulb with an inert dry gas doubled its luminous efficiency. Although this field of art is different from the present one, and the technical issues presented were quite different, this is perhaps a thought provoking example of an advance in product efficiency resulting from the replacement of a vacuum with a dry gas.

In general, these prior art technologies are not cost-effective technologies and they rely on extremely large and complicated canister designs in relation to the beverage food product containers within which they are contained. In fact, the ratio of desiccant to water is about 3:1 and the ratio of the volumetric loss in such beverage food product containers is about 40%. The cost of the desiccant or sorbent, the cost of the food product container, and the cost of the process of manufacture are prohibitive, despite nearly 20 years of trials. Thus it is advantageous to reduce the amounts of these components needed and to restructure the manufacturing process to divorce the interior of the food product container from these chemicals.

For example, U.S. Pat. No. 7,107,783 to Smolko et al, discloses self-cooling containers using desiccants that comprise porous matrices as elements of the container bodies to effect the cooling of contained liquids by pervaporation. On line The liquid vapor can pass through the porous matrix directly to the environment or to a collector or trap comprising an absorbent material in contact with the container. The porous desiccant matrix is contained in a sleeve-like container that surrounds the beverage. The cost of manufacture of such sleeves is prohibitive for commercialization of such devices and they also require careful use of porous matrices that can be delicate and brittle. Further, such porous matrices are prone to absorption of atmospheric gases which render such devices inert without a vacuum. Vacuums are very difficult to maintain in pressurized carbonated beverages over a period of time. As another example, Siegel; Israel (North Miami Beach, FL) reveled in U.S. Pat. No. 4,928,495 self-cooling and self-heating beverage containers utilizing water, the boiling point of which has been lowered by a vacuum as the working cooling fluid. A desiccant placed in a separate container sorbs the vapor generated by the boiling water at a low pressure to cool the beverage. This invention also requires a vacuum that has to be stored over a period of time and as such are prone to failure due to the difficulty of maintaining a vacuum over time. Further the invention requires several components and several interconnected means for actuation rendering it impractical for commercialization purposes. Another example is provided by Stewart Molzahn of Bass brewers in U.S. Pat. No. 6,141,970. His invention again relies on a vacuum which is stored within the desiccant chamber separated from water in a separate chamber by a thin membrane. Suffice it to say that such membranes can leak over time and render the apparatus useless over a short period of time. Further, a vacuum required the use of very stiff storage members that become cost prohibitive for commercialization of such devices.

Further examples of devices that use this technology are found in U.S. Pat. Nos. 7,107,783, 6,389,839, 5,168,708, 6,141,970, 829,902,4, 462,224, 7,213,401, 4,928,495, 4,250, 720, 2,144,441, 4,126,016, 3,642,059, 3,379,025, 4,736,599, 4,759,191, 3,316,736, 3,950,960, 2,472,825, 3,252,270, 3,967,465, 1,841,691, 2,195,0772, 322,617, 5,168,708, 5,230,216, 4,911,740, 5,233,836, 4,752,310, 4,205,531, 4,048,810, 2,053,683, 3,270,512, 4,531,384, 5,359,861, 6,141,970, 6,341,491, 4,993,239, 4,901,535, 4,949,549, 5,048,301, 5,079,932, 4,513,053, 4,974,419, 5,018,368, 5,035,230, 6,889,507, 5,313,799, 6,151,911, 6,151,911, 5,692,381, 4,924,676, 5,038,581, 4,479,364, 4,368,624, 4,660,629, 4,574,874, 4,402,915, 5,233,836, 5,230,216. U.S. Pat. No. 5,983,662 uses a sponge in place of a desiccant to cool a beverage.

Prior art also reveals chemically endothermic self-cooling food product containers. These rely on the use of fixed stoichiometric reactions of chemicals to absorb heat from the food product container contents. U.S. Pat. No. 3,970, 068, to Shataro Sato reveals a heat exchange packaging that uses chemicals to cool and heat food products respectively. However, Shataro Sato reveals an invention that uses two chambers isolated from one another by a barrier that can be pierced by a needle to mix the reactants to cool or heat a food product. On line 64 page 2, he states, "said needle-member 23, as shown c) in FIG. 2, comprises a base portion 27, an oval portion 26 and an upper portion 28 having a forward tip 32, said base portion 27 as shown in FIG. 3 being provided with two arc-shaped saws 29 projecting therefrom in opposite directions, said saws 29 cutting into said cylindrical portion 22 axially at the lower portion thereof providing a longitudinal opening 31 for facilitation the outflow of water from compartment C at the time of conducting the thermal reaction process." The invention of Sataro reveals a complication actuation means for mingling the reactants that form a thermal cooling system using endothermic reactions. The present inventor reveals a far simpler method of achieving the same using a simple cost effective means as revealed hereunder.

U.S. Pat. No. 2,300,793 to V. E. C Martin reveals a dual container for heating a products using reactants. Again on line 43 page 2 he states, "The medial portion of can bottom 5 may then be given a sharp blow or blows to force punch 19 to pierce or puncture the partition1." This actuation means revealed by several inventors including Martin is indeed cost prohibitive and the method reveals one of the reasons why all such prior inventions have been unsuccessful commercially.

Other patents such U.S. Pat. No. 7,117,684 to Scudder, et al., reveals an endothermic cooling process for self-cooling containers. Scudder also reveals a means of activation of his device using a piercing device to break a barrier between two reactants. On line 59, page 1, he states, "Depressing the actuator button forces the prong into the barrier, puncturing it thereby allowing the liquid reactant to flow into the solid reactant in the reaction chamber." Once again, the piercing technic is used to mix chemical reactants at the cost of commercialization. The cost of manufacturing the piercing device is prohibitive and added to this cost is the complicated pleated design of the reaction chamber and entire apparatus according to Scudder.

U.S. Pat. No. 4,993,237 to Bond, et al. also reveals a similar method to the method revealed by Scudder et al., for an endothermic cooling system. Bond reveals a method that uses a long member to break a seal when the opening means of the conventional can is used to open the can. In line 58, page 3, Bond states, "The initialization rod 20 is long enough to extend substantially to the breakaway seal 18 shown in FIG. 6 and specifically a seam 21 therein." It is very important to note that such a rod must be aimed just right to break open the seam 21 as recited. Further, it must be oriented properly at all times to be activated by the opening means of the can. Further, the rod must be rigid and made from a suitable metal and thus must be expensive to make (a few cents) that adds to the cost of the apparatus. Further, having a sharp rod inside a consumer product is not advisable.

When I worked as a volunteer aid in Africa, a metal rod to from a machine entered a local brewery's bottling line and infiltrated a beer bottle. A friend of mine was unfortunate enough to get this particular bottle and was nearly hospitalized, were it not for the kind work of a local doctor.

U.S. Pat. No. 3,229,478 to Jose Alonso also reveals a self-cooling container with a valve device and a vacuum chamber for actuating the apparatus. On line 1 page 3, Alonso states, "The can body 12 of the outer can, the body 66 of the inner container 62 and the top wall 22 of the compartment 18 defines the vacuumized chambers 76 in which is located the refrigerant valve device 32 and which is normally free of air thereby providing a vacuum state."

The use of a vacuum is prohibitive in the commercialization of a self-cooling container. It is expensive to implement and can leak in a carbonated environment. Further as will be described further, it is not the effective to store a vacuum to achieve the desired results. Other patents that use endothermic cooling means include, U.S. Pat. Nos. 4,773,389, 3,561,424, 3,950,158, 3,887,346, 3,874,504, 4,753,085, 4,528,218, 5,626,022, and numerous others use endothermic reactions remove heat from water to cool the beverage food product container. These prior art technologies require two containers that may be connected by a breakable membrane and other means. They particularly do not permit the sorption of the humidification liquid to be achieved by automatic vacuum generation within the chemical chamber to permit complete solvation and complete use of the maximum surface area available.

For example, as stated earlier, Shotaro Sato of Osaka, Japan reveals an endothermic cooling process and apparatus in U.S. Pat. No. 3,970,068. Sato depends on using a valve system that is pushed by a finger from the outside of the beverage container so that the bottom cover pushes a needle existing between the compartments accommodating the exothermal or endothermal reaction agent and the reaction-inducing agent respectively, and to permit the two agents mix to produce thermal reaction as the result. The use of these specialized valves are common in most of the patents that involve endothermic reactants. Further, Sato uses a mechanism that requires sophisticated manufacturing processes with rigid non-flexible containers resulting in cost prohibitive manufacturing technics.

As stated earlier, Scudder, et al. reveal another version of an endothermic cooling device in U.S. Pat. No. 5,626,022. Scudder reveals a container for holding a material, such as a food, beverage or medicine, includes a cap and a container body. The container body has a material cavity unitarily formed with a reactant cavity. The reactant cavity contains a solid reactant, and the cap contains a liquid reactant that, when mixed, produce an endothermic or exothermic reaction, depending upon the reactants selected. The cap has a tubular body section with an actuator disc closing one end and a breakable barrier closing the other end. With the exception of the barrier, the cap is of unitary construction. The cap has one or more prongs extending from the inner surface of the disc toward the barrier. When a user depresses the actuator disc, it flexes inwardly and moves the prongs toward the barrier. The reactants mix when the prongs puncture the barrier. Heat transferred between the two cavities heats or cools the material. The wall of the container that defines the reactant cavity may be pleated or corrugated to promote heat transfer. Again, this inventor respectfully reveals a method of manufacture that is cost prohibitive and inefficient for endothermic cooling.

In U.S. Pat. No. 4,753,085, Bernard Labrousse L. P. E. of France reveals a single-use heat transfer packaging for drinks and foodstuffs which comprising a receptacle containing drink or food to be consumed, a thermal capsule being immersed at least partially into the drink or food, the said capsule having a portion which is deformable by pressure or by traction, triggering an exothermal or endothermal chemical reaction. In Labrousse's patent, pressure is used to trigger the cooling by actuating a valve that separates the reactants. He states on line 67, page 4, "By pressure on the deformable wall 27 directly or through a push member or perforator, the deformation can be transmitted to the capsule 25 by means of a push member, a screw or a key. In contrast to the embodiments shown in FIGS. 1 to 3, distribution may be carried out both at the level of the wall 27 and at the level of the wall 35 of the receptacle 24, the wall of the capsule then becoming the wall of the receptacle. Distribution may be performed by totally cutting out or detaching and removing one or other of the walls 27 or 35. It is likewise possible to provide protection at the level of the deformable wall 27." The displacement of the valve "injects" liquid into the endothermic reactants to cause cooling. However, the spaces and surfaces uses for the liquid components become void surfaces that do not contribute to cooling effect, thus a substantial amount of cooling capacity can be lost due to these restrictions. Further, the designs require rigid component containers that hold both reactants and thus become cost prohibitive for manufacturing a commercially viable apparatus.

The present invention differs from all the mentioned prior art and provides a novel cost effective and thermodynamically simple and viable means for cooling a beverage in a food product container by using the cooling potential of fixed amounts of reactants using electromotive force of a dry gas acting on a humidification liquid of suitable choice to achieve advantageous cooling of a beverage. Many trials and designs have been made to obtain the present configuration of the disclosed invention.

U.S. Pat. No. 10,018,395 to Darlene S. Boyd issued Jul. 10, 2018 also illustrates an endothermic cooling system. However, the use of dry gas is not revealed and again a rupturable-membrane is disclosed. In Boyd's disclosure she states on line 2, page 4, "The first chamber 16 and the second chamber 18 are separated by a barrier 24 that prevents the cooling agent from contacting the activating agent prior to activation of the beverage cooling device. The barrier 24 is further configured to be ruptured upon activation of the beverage cooling device such that the cooling agent and the activating agent come into contact with and react with each other in an endothermic reaction."

The problem Boyd has in implementing the invention is that if the mere flexing of the barrier can force the vessel to change its shape and rupture the barrier, then it is able to rupture the walls of the barrier as well. She reveals on line 51, page 4, "The second chamber 38 is within the first chamber 36, and the barrier 34 surrounds the second chamber 38. In this manner, the barrier 38 forms a second chamber housing. As discussed above, the beverage cooling device 30 may be activated by flexing or squeezing the housing 32 such that the barrier 34 ruptures and releases the activating agent 42 to contact the cooling agent 40." It is obvious that the invention does not teach how to activate the apparatus just using the opening means of the beverage container, but instead reveals that the apparatus that must be sterile and internal to the beverage container is "activated by flexing or squeezing the housing 32 . . . ". Further, no other invention thus far revealed has demonstrated the features and advantages that are revealed in the present invention. The foregoing summarizes some of the special advantages of the present invention over prior art.

1.0 Deficiencies of Prior Art Devices that Use Endothermic Cooling Systems a) All prior art endothermic cooling systems mentioned and cited earlier have a limited potential to solvate and then cause cooling since the solvation energy of the ionizable compounds used, for example, usually depends on the temperature of a solvent such as water. The water acts as humidification liquid to ionize chemicals, and as the ions redeem energy of solvation as the solvent cools, the process becomes energy deficient, making the process of extraction of solvation energy exponentially slow, and as such, these technologies do not use the full potential of the solvation energy available. For example, to cool 16 oz of beverage by 30° F. one needs to dissolve at least 127 g of potassium chloride in about 380 g of water. This is not commercially viable in a self-cooling food product container technology that relies only on this process. The present invention overcomes this deficiency by means of an extremely dry gas. Dry gas with a dew point of 10° F. to −150° F. can easily absorb vapor from a liquid that is cooled to freezing point without a vacuum. The interstitial spaces between endothermically reacting chemical compounds used in crystalline form as reactants is considerable. As a matter of fact, well over 40% of the free interstitial space between such crystalline structures is not used for cooling. Further, dry gas simply increases its dew point temperature when it absorbs moisture, while the actual thermometric temperature of the dry gas itself remains constant.

b) Further, stored endothermically reacting chemical compounds used for endothermic cooling with a solvent such as water require a stoichiometric molar ratio with water for the purpose of cooling. The main problem with prior the art is the fact that the water must be permitted to enter into the solutes and dissolve the solute leaving a void where the water is stored as an empty space that serves no purpose whatsoever. Further, the water is permitted to fall into the chamber holding the reacting chemicals by gravity such that the cooling generally occurs at a lower level than the headspace leaving the headspace of the beverage uncooled. Since cold liquids tend to fall to lower levels by gravity, no cooling occurs above the reactant space just below the water top level. This problem is solved by the present invention by means of a dry gas, and also by incorporating a novel actuation system for the cooling process. The process is designed to absorb the humidification liquid as vapor and automatically generate a vacuum to completely suck up the humidification liquid into the solutes chamber regardless of orientation of the apparatus in the beverage container. This also permits the cooled solution to complete contact the dry gas chamber walls and thus cool the product more efficiently. Further, all interstitial spaces are used for cooling as the solvent is pulled by the dry gas to fill these spaces. The present invention generates a vacuum using dry gas and efficiently eliminates the need to maintain a pre-formed vacuum over a long period of time. The vacuum is immediately generated by the absorption of humidification liquid by dry gas and vice-versa. A vacuum is further generated by the present invention when the solutes dissolve in the solvent and a volume loss occurs. This solves the issue of minimizing the volume occupied by the solute in the apparatus as it dissolves into the solvent.

| BEFORE INSERTION INTO BEVERAGE CONTAINER | AFTER INSERTION INTO BEVERAGE CONTAINER | AFTER OPENING BEVERAGE CONTAINER |
|---|---|---|
| REACTING CHEMICAL COMPOUNDS IN DRY GAS CHAMBER FILLED WITH DRY GAS AND SEPARATED FROM HUMIDIFICATION LIQUID BY UNCOMPRESSED FULL CROSS SECTIONAL AREA OF COMPRESSIBLE PLUG MEMBER FILLING THE UNCOMPRESSED FULL CROSS SECTIONAL AREA OF THE CHAMBER CONNECTION STRUCTURE | REACTING CHEMICALS COMPOUNDS IN DRY GAS CHAMBER FILLED WITH DRY GAS AND SEPARATED FROM HUMIDIFICATION LIQUID BY COMPRESSED REDUCED CROSS SECTIONAL AREA OF COMPRESSIBLE PLUG MEMBER FILLING THE COMPRESSED REDUCED CROSS SECTIONAL AREA OF THE CHAMBER CONNECTION STRUCTURE | REACTING CHEMICALS COMPOUNDS IN DRY GAS CHAMBER FILLED WITH DRY GAS PULLS A VACUUM, COOLS, AND DRAWS HUMIDIFICATION LIQUID AND VAPOR THROUGH GAP MADE BETWEEN UNCOMPRESSED REDUCED CROSS SECTIONAL AREA OF COMPRESSIBLE PLUG MEMBER AND THE UNCOMPRESSED EXPANDED CROSS SECTIONAL AREA OF THE INTERCONNECTION STRUCTURE AND MINGLES WITH HUMIDIFICATION LIQUID TO COOL. ONE OF THE HUMIDIFICATION LIQUID CHAMBER AND THE DRY GAS CHAMBER IS COLLAPSIBLE. |

c) Further, in the present invention, the food product container itself is not modified in any intrusive manner and the manufacturing process of the food product container is unaffected by the methods used to manufacture the present apparatus. Hence, advantageously, as well as the properties of materials used acting in a beneficial manner, the present invention bypasses the need for a stored vacuum and avoids other deficiencies of prior art devices by using properties of electromotive vapor and heat transport using dry gases in a low vapor pressure state with dew point temperatures in the range 10° F. to −150° F.

d) Further, as an added advantage, the present invention uses an inexpensive collapsible, flexible and a partially flexible deformable interconnection structure with a compressible plug member made of one of a suitable rubber, putty, cork, closed foam, and sealing waxes seal to perform a sealing function and an actuation function. Advantageously, the present invention does not necessarily require pins, knives, external forces and other methods to introduce water vapor to the reacting chemical compounds. The interesting aspect of the present invention is that it permits the apparatus to be in a sealed configuration prior to use and during storage and permits the apparatus to be in an operable condition when the carbonation pressure is removed. Thus carbonation is used as a reset of the interconnection structure from a sealing state to a sealing state under pressure and then to an unsealed state.

e) Further, as an added advantage, the present invention uses a collapsible, flexible cooling receptacles such made from plastic bag materials to permit the vacuum generated by the interaction of either the dry gas with the humidification liquid or the solvation process of the chemical reactants to minimize the volume of the humidification liquid chamber and permit the reactants to cool and contact the entire surface area of the cooling assembly that is available.

Essentially, the following process occurs on the interconnection structure: Sealed at Atmospheric Pressure—Sealed Under Carbonation Pressure—Open at Atmospheric Pressure.

It is thus an objective of the present invention to provide a method of cooling a food product container using a novel simple means to remove heat from a food product using dry gas.

It is another objective of the present invention to provide a method of assembling the self-cooling a food product container in its completed form with a food product such as a beverage therein with a dry gas absorption means to generate a vacuum for pulling humidification liquid into the a chamber with endothermic reactants and dry gas for an endothermic cooling of a food product container.

It is still another object of the present invention to provide a self-cooling apparatus for cooling a food product container using a conventional filled and sealed food product container in its completed form using simple materials such as a thin plastic bag to cool a food product.

It is a further object of the present invention to provide an apparatus that uses the humidification of a substantially dry gas to evaporate water from solutions of ionized chemical compounds to generate a vacuum for pulling humidification liquid to endothermically reacting chemical compounds without the need for special orientation.

It is a further object of the present invention to provide an apparatus that uses dry gas to evaporate a liquid to further cool by evaporation.

It is finally an object of the present invention to provide an apparatus that is thermodynamically simple, viable, and cost effective for removing heat from a food product and thereby cooling the same.

The present invention accomplishes the above-stated objectives, as well as others, as may be determined by a fair reading and interpretation of the entire specification.

The efficiency is in the direct transfer of the bond energies from broken humidification liquid molecules to the reformation energy of humidification liquid vapor as a vapor that is immediately transported away or absorbed by dry gas humidification and taken away. An example using water is shown in FIG. 18.

A food product container is provided, including a food product container having a release port and a release port opening means. The food product container preferably is one of a metal can and a plastic bottle. A dry gas is provided preferably having a dew point temperature in relation to humidification liquid vapor below 10° F.

SUMMARY OF THE INVENTION

The present invention accomplishes the above-stated objectives, as well as others, as may be determined by a fair reading and interpretation of the entire specification.

Dry gas such as substantially dry air, substantially dry $CO_2$, substantially dry Nitrogen, substantially dry Dimethyl ether, several other types of dehumidified gases such as Solstice® L41y (R-452B), Solstice® 452A (R-452A), Solstice® L40X (R-455A), Solstice® zd, Solstice® ze, (R-1234ze), Solstice® yf (R-1234y) with very low dew point temperatures can cause extreme cooling.

Dry air in particular can cause extreme cooling as is evidenced by weather patterns that are predominantly driven by the humidity of air and heat energy available in the atmosphere. Not surprisingly, dry air can result in dramatic snow and ice formation, in turn resulting in extreme weather patterns across the world. It is not surprising that lip-balm used for dry lips sells well in winter. From hurricanes to tornadoes, to heavy snow storms, and icy winter storms, nature has provided an amazing electromotive heat transport means that can be emulated to assist in cooling a beverage and a food product using humidification and dehumidification of air. It is my theory that the tremendous vacuous energies of a tornado are a result of the sudden condensation of water vapor from the dehumidification of humidified dry air. Water vapor is 1840 times the volume of the same weight of liquid water, and so when a huge cloud condenses, a tremendous reduction in volume is obtained resulting a vacuum which appears as a funnel cloud of a tornado. No simple wind motion can generate such tremendous energies. Similarly, the humidification of very dry air results in very cold temperatures that results in snow storms. This happens as moisture is picked up by dry air and evaporated to remove heat from the surrounding environment followed by saturation of the same wet air which again deposits its vapor as moisture in as snow and hail.

Water has the best thermodynamic potential to cool a food product. It has the highest heat of evaporation and as such it can be used in combination with electromotive drying and regenerative processes that also rely on water molecules to cool a food product container. However, water does not easily evaporate due its high heat of evaporation and as such it must be "enticed" to do so by an appropriate means. Further, as water cools, for example in an endothermic reaction, and in a desiccant evaporation system, it becomes more and more difficult to evaporate it. Thus, neither endothermic cooling nor conventional desiccant cooling systems of prior art by themselves prove to be the most efficient forms of cooling a food product such as beverage. The combination of dry gas mediation, and other cooling methods can use the two fundamental substances, water and a dry gas, to effectively increase the thermodynamic potential to cool a food product. However, an inventive step of causing vacuums generated by the interaction of dry gases and a humidification liquid to maximize the cooling surface area of the apparatus is intended. Further, the additional inventive step of using flexible containers for the humidification liquid and the reactive chemicals such that a dry gas when interacted with the humidification liquid causes a vacuum that then minimizes and collapses the volume of the containment structures used for the invention is intended. Further, the additional inventive step of using the solvation of chemicals to generate a vacuum for the purposes of minimizing the volume of the containment structures used for the invention is intended.

Definitions

The following definitions are generally used to describe some terms used in the present disclosure to describe this invention.

"Food product container" for the purposes of this application shall mean a food product container either made from metal or made from plastic and containing a food or beverage product as used by the invention.

"Food product" for the purposes of this application shall mean any substance that is a consumable item preferably a liquid beverage;

"Dew point temperature" for the purposes of this application shall mean the temperature at which the vapor of a humidification liquid in a sample of dry gas at constant barometric pressure condenses into humidification liquid at the same rate at which it evaporates.

"Headspace" for the purposes of this application shall mean the carbonation filled space in a sealed beverage container that is above the beverage level.

"Dry gas" for the purposes of this application, shall mean a gas with a substantially low partial water vapor pressure with a dew point temperature less than 50° F. that fills interstitial spaces between particles of endothermically reacting compounds. It is noted that the dry gas itself could be liquefied and mixed in with said endothermically reacting compounds;

"Wet gas" for the purposes of this application, shall mean a dry gas humidified to have a higher water vapor pressure than dry gas and a dew point temperature greater than 10° F.

"Heat transport means" for the purposes of this application, shall mean a thermodynamic and electromotive potential to exchange heat between substances;

"Compressible plug member" for the purposes of this application shall mean any structure made from materials such as a wax, a rubber, a plastic or a metal used to form a pressure activated valve in the form of a sealing plug to temporarily seal a cross-sectional area exposed to a fluid and preventing said fluid from passing through said cross-sectional area and such that said material can be compressed by pressure to a smaller cross-sectional area in a sealing configuration and such that upon release of said pressure, said material remains with smaller cross-sectional area.

"Interconnection structure" for the purposes of this application, shall mean a segment of the walls of a cooling assembly that is between a dry gas chamber and humidification liquid chamber.

"Collapsible" for the purposes of this application shall mean the reduction in volume of a closed space without a change in the surface area of the walls enclosing said volume.

"Pressure activated valve" for the purposes of this application shall mean a deformable and compressible plug member sealing inside the walls of a compressible interconnection structure and forming a non-permanent barrier between a humidification liquid chamber and a dry gas chamber containing endothermically reacting chemical compounds such that when the compressible interconnection structure is compressed by pressure, its cross-sectional area reduces and compresses the pressure activated valve to a smaller cross-sectional area and remains in a sealing configuration with the said compressible interconnection structure, and when the pressure is removed around the compressible interconnection structure, at least partially expands back to its original shape leaving the pressure activated valve with its smaller cross-sectional area and forming a gap between said pressure activated valve and the compressible interconnection structure to open fluid communication between the humidification liquid and the dry gas chamber.

"Humidification liquid chamber" for the purposes of this application shall mean a space containing humidification liquid sealed by one or more pressure activated valves.

"Endothermically reacting chemical compound" for the purposes of this application shall mean any chemical solid, liquid or gaseous compounds that can react with water and solvents to cool endothermically and that can dissolve in humidification liquid such as water to form ions from its elements or a combination of its elements thereof and cool endothermically.

"Humidification liquid" for the purposes of this application shall mean any liquid that is used to react with endothermically reacting chemical compounds to generate endothermic cooling and such liquid may include water and beverage.

"Collapsible volume" for the purposes of this application shall mean a closed structure having an internal volume with enclosing structure walls that can be restructured by the force of a vacuum to reduce the overall enclosed volume, specific examples being the reduction of said enclosed volume by bending said walls, the reduction of said enclosed volume by telescoping said walls, the reduction in said enclosed volume by the relative sliding of sections of said walls.

Humidification liquid vapor" for the purposes of this application shall mean the vapor of any humidification liquid.

"Dry gas chamber" for the purposes of this application is a functional structure that preferably contains a dry gas and may hold endothermically reacting chemical compounds in the form of solids or liquids within it.

"PVC" for the purposes of this application shall mean heat-shrinkable polyvinyl chloride.

"PET" for the purposes of this application shall mean heat-shrinkable polyethylene tetraphthalate.

"Upright" for the purposes of this application shall mean vertical orientation.

"Interconnection structure" for the purposes of this application shall mean a wall portion of a cooling assembly wall that abuts and sealing surrounds a compressible plug member.

For orientation purposes and clarity, the food product container is assumed to be standing in an upright, vertical orientation with the food product container's bottom resting on a horizontal plane.

This invention uses the thermodynamic potential of the evaporation of a humidification liquid such as water, water-ethanol azeotropes, dimethyl ether-water azeotropes, or a suitable liquid and the ability of a substantially low vapor pressure medium such as a dry gas to force this evaporation from even cold liquids. To do this, a standard food product container such as a can or a bottle is provided. "Food product container" is preferably a cylindrical beverage food product container of standard design, and with standard food product release means and a standard food product release port.

Method of Manufacture of the First Embodiment of the Present Invention

In the first embodiment, shown in FIGS. 1-9, 14 and 15, a cooling assembly comprising an elongate cooling assembly vessel with thin walls in the form of a bag and having a vessel first end segment and a vessel middle segment and a vessel second end segment is formed using lay-flat thin walled tubing material. A humidification liquid chamber is provided including a vessel first end segment containing a humidification liquid. The humidification liquid chamber wall is sealingly connected to a chamber interconnection structure comprising the vessel middle segment wall sealing connected to a dry gas chamber wall comprising the vessel second end segment. The interconnection structure has an interconnection structure wall made from materials that are one of resilient and partially resilient materials such as certain plastics, silicone and aluminum. A compressible plug which is made from one of non-resilient and partly resilient and contained within the interconnection structure with a cross-sectional area and shape matching the initial interconnection structure internal cross-sectional area to sealingly abut the interconnection structure, to form a seal against the passage of fluid from the humidification liquid chamber while subjected to the container internal pressure created by said carbonated beverage.

Thus, a humidification liquid chamber, and a dry gas chamber, with an interconnection structure between the two, are provided in the form of a flexible and collapsible structure such as a bag formed with thin bag material preferably in the form of lay-flat plastic bags with a metallized lining. By collapsible is meant that the shape and volume contained within the flexible humidification liquid chamber walls can change as a result of pressure changes.

As shown in FIG. 7, the first step in manufacturing the apparatus provides a thin walled lay-flat tubing with an expanded rounded diameter of about 2-3 inches and about 4-8 inches long and with open ends. The length of lay-flat tubing 105 used depends on the height of the food product container that will be used with the invention. For example, an 18 oz standard aluminum beverage container will need about a 7" long lay-flat tubing.

The interconnection structure is provided. The interconnection structure is made from a preferably a ½" to ¾" silicone tube that is about 1" long. The interconnection structure is therefore deformable and compressible when a force is applied to its walls but can to go back to its original shape when the deforming force is removed. The interconnection structure is first placed inside the lay-flat tubing with is axis parallel to the axis of the expanded lay-flat tubing. It is positioned centrally along the length of the lay-flat so that its length and width project symmetrically from the center point of the lay-flat tubing. Then a heat sealer is used to seal across the center of the lay-flat tubing to forms seal that divides the length of the lay-flat tubing into two equal portions with open ends. The interconnection structure in this case will not be affected by the heat sealing of the lay-flat tubing since the melt temperature of silicone material is far higher that the melt temperature of the lay-flat tubing. However, the interconnection structure will be trapped in the center of the lay-flat tubing to form a tubular fluid connecting structure between the two halves of the lay-flat tubing.

As shown in FIG. 7 in some instances, if material economy is required, the interconnection structure can be made by heat sealing a narrow neck portion of the lay-flat tubing preferably centered on its length and width to form an open ended a humidification liquid chamber and an open ended dry gas chamber respectively with the two chambers connected by the interconnection structure. This can be achieved for example by heat sealing a narrow portion of the center of the length of the lay-flat tubing to capture the interconnection structure as shown in FIG. 7. This is not absolutely necessary as shown in FIGS. 7*a* and 15 since the invention works without this narrowing step. The humidification liquid chamber, the dry gas chamber and the interconnection structure thus formed are preferably made from a single thin-walled, flexible and collapsible aluminum or plastic lay-flat tubing 105 material such as one of thin PET, PVC, Polyethylene, and Polycarbonate, for example. Preferably, the lay-flat material is a bag material used made from substantially impervious film to that prevent to a great extent the beverage and carbonation gases from passing through its walls. Thus, when the formed structure described above is expanded into its full diameter, an open ended humidification liquid chamber is formed and an open ended dry gas chamber is formed respectively and both chambers are connected by the interconnection structure. The dry gas chamber can also be made with dry gas chamber walls that form a collapsible structure with a shape and volume that can change as a result of a pressure change. In particular, a vacuum generated within the dry gas chamber can collapse its volume. Both the dry gas chamber and the humidification liquid chamber can also be made as separate structures from the same lay-flat tubing 105 and connected sealingly to the open ends of a tubular interconnection structure by means of thermal welding. The interconnection structure may be made with any of several possible cross-sectional shapes to sealingly connect the dry gas chamber to the humidification liquid chamber. It is obvious that the interconnection structure may be composed in sections that can be connected together for ease of assembly of the cooling assembly. Thus the humidification liquid chamber and the dry gas chamber can be fluidly connected by the interconnection structure with the compressible plug member preventing any fluid communication between the two chambers to form a cooling assembly of the apparatus.

If the bag material used to form the cooling assembly is too thin, a supporting flexible silicone rubber tube may be added to line the inside walls of the interconnection structure to permit the interconnection structure to be compressed to a smaller cross-sectional area by pressure acting around its outer surface, and to permit its walls to bounce back to the original shape when the pressure is released. Thus the interconnection structure may be made as a separate segment a thin-walled flexible tube. The interconnection structure may also be made from a one of a silicone rubber material and a plastic material to permit its walls to be compressed by external pressure to a smaller cross-section and yet also permit it to bounce back to its original shape when the compressing pressure is released and alternatively, it may be made as mentioned above from thin bag material that is reinforced by one of a rubber tube and a plastic tube to permit it to bounce back to its original shape when deformed by pressure. It may also be made from an elastic plastic that can be compressed by pressure and that will bounce back to its original shape when the pressure is released.

The next step in making the apparatus is to fill the inside of the interconnection structure with a compressible plug member to serve as a pressure activated valve for the apparatus between the humidification liquid chamber and the dry gas chamber. The compressible plug member which serves as a pressure activated valve, is preferably made from a suitable deformable material, one of non-resilient and only partially resilient material such as a non-water-soluble wax, a rubber, a plastic, cork, closed foam, and a non-soluble putty. The compressible plug member is placed to sealingly plug and seal either a portion or the entire interconnection structure to sealingly separate the dry gas chamber from the humidification liquid chamber. The compressible plug member can also be made as a deformable metal or plastic disc that snugly fits the circumferential diameter of the inside of the interconnection structure to act as a barrier between the humidification liquid chamber and the dry gas chamber. As shown in FIG. 15, a compressible plug member can also be made from one of a deformable and compressible plug ring made from one of a thin metal or plastic ring with a thinner collapsible membrane portion in the form of a disc. The compressible plug ring member could for example, be an O-ring that is compressible to a smaller diameter into a slot made along around the collapsible membrane. As long as the diameter of the compressible plug member 108*a* can be shrunk irreversibly from its original diameter, the material of the collapsible membrane portion will collapse and permit only partial or no return of the compressible plug ring to its original cross-sectional area. Thus materials such as flexible low density polyethylene and flexible PVC that can be irreversibly compressed by pressure to a smaller diameter in cross-sectional area may be used. Thus the compressible plug ring seals and separates the humidification liquid chamber 104 from the dry gas chamber before and during storage of the apparatus in its final form. The interconnection structure may be incorporated as a portion of the cooling assembly wall to sealingly connects the dry gas chamber to the humidification liquid chamber. Alternatively, the narrowing of the lay-flat tubing 105 to form a narrow neck for a smaller interconnection structure is only necessary if the amount of material used to form the compressible plug member needs to be reduced to minimize its thermal penalty on the cooling capacity of the apparatus. Thus the cooling assembly may also be formed from a single unaltered tubular bag material as shown in FIGS. 7*a*, 14 and 15. Then, advantageously only the open ends of the bag forming the humidification liquid chamber and the dry gas chamber need to be heat sealed during construction of apparatus. As shown in FIG. 15, an alternative means of making the apparatus a compressible plug member as per the prior embodiments can also be made from one of a deformable and compressible plug ring made from one of a thin metal or plastic ring with a thinner collapsible membrane portion in the form of a disc. As long as the diameter of the compressible plug member can be shrunk irreversibly from its original diameter, the material of the collapsible membrane portion will collapse and permit only partial or no return of the compressible plug ring to its original cross-sectional area. Thus materials such as flexible low density polyethylene and flexible PVC that can be irreversibly compressed by pressure to a smaller diameter in cross-sectional area may be used. Thus the compressible plug ring seals and separates the humidification liquid chamber from the dry gas chamber before and during storage of the apparatus in its final form. The interconnection structure may be incorporated as a portion of the cooling assembly wall to sealingly connects the dry gas chamber to the humidification liquid chamber. Alternatively, the narrowing of the lay-flat tubing 105 to form a narrow neck for a smaller interconnection structure is only necessary if the amount of material used to form the compressible plug member needs to be reduced to minimize its thermal penalty on the cooling capacity of the apparatus. Thus the cooling assembly may also be formed from a single unaltered tubular bag material as shown in FIG. 7*a*, FIG. 14 and FIG. 15. Then, advantageously only the open ends of the bag forming the humidification liquid chamber and the dry gas chamber need to be heat sealed during construction of apparatus.

The next step in manufacturing the apparatus is filling the dry gas chamber with granular forms of the endothermically reacting chemical compounds through its open unsealed end. The endothermically reacting chemical compounds should be made to fill and contact the maximum possible surface area of the dry gas chamber walls. Of course while the surface area of the dry gas chamber is fixed by the lay-flat tubing material area available to form the dry gas chamber, however, the volume of the dry gas chamber depends on the extent to which the lay-flat tubing that forms the dry gas chamber is expanded. Advantageously any volume between the maximum expanded volume and the minimum lay-flat volume of the two chambers can be accommodated in the same surface area of the dry gas chamber.

The next step is to flood the dry gas chamber with a dry gas, preferably one of dry $CO_2$, dry dimethyl ether (DME), and one or combinations of DME, $CO_2$, Solstice® L41 y (R-452B), Solstice® 452A (R-452A), Solstice® L40X (R-455A), Solstice® zd, Solstice® ze, (R-1234ze), Solstice® yf (R-1234yf). The dry gas is filled by simply blowing it at a low flow rate through the granules of the endothermically reacting chemical compounds to replace any air that fills the interstitial spaces between the granules of the endothermically reacting chemical compounds. The next step is to thermally seal the dry gas chamber by heat sealing the open end of the dry gas chamber to form a closed dry gas chamber.

The next step in the assembly of the apparatus is to fill the humidification liquid chamber with humidification liquid. The humidification liquid must be chosen to react endothermically with the endothermically reacting chemical compounds and to also evaporate when subjected to the dry gas. Preferably, the humidification liquid is water. The humidification liquid should contact the maximum possible surface area of the humidification liquid chamber that is available. Of course while the surface area of the dry gas chamber is fixed by the lay-flat tubing material, the volume of the humidification liquid chamber depends on the extent to which the lay-flat tubing that forms the humidification liquid chamber can be expanded. Advantageously any volume between the maximum expanded volume and the minimum lay-flat volume of the two chambers can be accommodated. The next step is to thermally seal the humidification liquid chamber by heat sealing the open end of the humidification liquid chamber to form a closed humidification liquid chamber.

A standard beverage container is provided preferably in the form of a conventional metal can or in the form of a plastic bottle. The cooling assembly comprising the humidification liquid chamber, the dry gas chamber and the interconnection structure with the compressible plug member separating the two chambers is then inserted into the beverage container. Carbonated beverage is then filled into the beverage container by conventional means. A beverage container lid with a beverage container opening means is provided for closing the container and thereby sealing off the beverage with the cooling assembly to form the apparatus according to the first embodiment.

For a can, the beverage container opening means is also conventionally referred to as the "pull tab". However, in the case when the beverage container is a plastic bottle, the container opening means is a beverage container lid in the form of a conventional screw-on cap that seals a threaded neck portion of the bottle and also acts as the beverage opening means. When the beverage container is sealed off by the beverage container lid, carbonation pressure builds up. The carbonation pressure of the beverage compresses the humidification liquid chamber and the dry gas chamber and the interconnection structure until the internal pressure of the humidification liquid chamber and the dry gas chamber equals the carbonation pressure. The carbonation pressure also deforms the interconnection structure and compresses the interconnection structure and the compressible plug member to a smaller cross-sectional area than the starting cross-sectional areas while the compressible plug member still remains in a sealing configuration. The apparatus is now ready for use.

Method of Operation of the First Embodiment of the Invention

Upon opening the beverage container opening means, the change in internal pressure from loss of carbonation gases to atmosphere causes the interconnection structure to expand to its original state leaving the compressed compressible plug member at the smaller cross-sectional area. The difference in dimensions between the final compressed state of the compressible plug member and the starting uncompressed state of the compressible plug member forms a gap between the compressible plug member and the interconnection structure that permits fluid communication between the dry gas chamber and the humidification liquid chamber. The stages of compression and area reductions are shown in FIG. 5. Dry gas absorbs humidification liquid forming a vacuum and pulls humidification liquid into the dry gas chamber. The humidification liquid chamber collapses to accommodate its new volume. Some humidification liquid vapor is evaporated during this process as well, extracting heat from beverage product. The endothermically reacting chemical compounds react with the humidification liquid and dissolve endothermically to cool the beverage product. The solvation causes a further reduction in volume of the humidification liquid chamber and this causes the walls of the humidification liquid chamber and the walls of the dry gas chamber to collapse to permit more humidification liquid and humidification liquid vapor to be pulled into the dry gas chamber. Thus a complete dissolving of the endothermically reacting chemical compounds occurs and cooling of the beverage product occurs and the entire cooling occurs in contact with the maximum area available in both chambers throughout the cooling process. It is important that the surface areas of the humidification liquid chamber and the dry gas chamber be respectively maximized for best cooling. As such the apparatus of this embodiment can be constructed using metallized bags connected by the interconnection structure as described above and as shown in the figures.

Method of Manufacture of the Second Embodiment of the Present Invention

A second embodiment of the invention is shown in FIG. 10.

In one preferred method of manufacture of the second embodiment, a humidification liquid chamber, a dry gas chamber and an interconnection structure are provided in the form of an injection-stretch-blown thin-walled container. A preform is made and stretch-blown to form the cooling assembly and take the shape of a bottle that forms the dry gas chamber, and to form an interconnection structure as a narrow neck connecting to a bellows-shaped chamber that forms the humidification liquid chamber as shown in FIG. 10.

The first step in forming a cooling assembly of the invention is to prepare a preform to form the two chambers and the interconnection structure as a single or multiple stretch-blown plastic pieces, preferably as a thin-walled structure, with flexible walls. The humidification liquid chamber is preferably a bellows-shaped structure while the dry gas chamber is preferably a cylindrically shaped structure, and the interconnection structure is preferably a small tube connecting the two chambers respectively. Preferably a plastic material such as one of PET, PVC, Polyethylene, and Polycarbonate, is used for this example. Preferably, the material used is made from substantially impervious film materials that prevent to a great extent beverage and carbonation from passing through its walls. If made as a single blown piece, a blow spout is provided and this blow spout can serve to fill the dry gas chamber, the interconnection structure and the humidification liquid chamber with their respective ingredients.

The second step in the making of the cooling assembly of the apparatus is to fill the humidification liquid chamber (the bellows) with humidification liquid through the blow spout. The humidification liquid must be chosen to react endothermically with the endothermically reacting chemical compounds and to also evaporate when subjected to the dry gas. Preferably, the humidification liquid is water. Of course while the surface area of the dry gas chamber is preferably substantially fixed as a cylinder, the volume of the bellows of the humidification liquid chamber depends on the extent to which its bellows shape can be expanded and contracted. Advantageously any volume between the maximum expanded volume of the bellows of the humidification liquid chamber and the minimum possible contracted volume of the bellows of the humidification liquid chamber can be accommodated.

The third step in making a cooling assembly according to the second embodiment of the invention is to fill the interconnection structure between the humidification liquid chamber and the dry gas chamber with a compressible plug member. The compressible plug member is preferably made from a suitable deformable structure made of one of non-resilient and only partially resilient material such as a non-water-soluble wax, a thin metal, a rubber, a plastic, cork, closed foam, or a putty. The compressible plug member is passed through the blow spout and placed to sealingly fill either a portion or the entire interconnection structure to separate the dry gas chamber from the humidification liquid chamber. The compressible plug member can also be made as a deformable metal disc and as a deformable metal cylinder such that it irreversibly deforms in cross-sectional area under pressure. Thus the compressible plug member material fluidly seals and separates the humidification liquid chamber from the dry gas chamber. The interconnection structure sealingly connects to the dry gas chamber and to the humidification liquid chamber. The compressible plug member, if made from a wax, can be simply melted and poured to substantially fill the interconnection structure. Since a wax floats on water for example, it is possible to fill the water in the humidification liquid chamber up to the start of the interconnection structure and then pour molten wax to float above the humidification liquid and fill the interconnection structure.

The fourth step in manufacturing the apparatus according to the second embodiment is filling the dry gas chamber with granular forms of the endothermically reacting chemical compounds through its open unsealed end. The endothermically reacting chemical compounds should be made to fill and contact the maximum possible surface area of the dry gas chamber walls.

The fifth step in manufacturing the apparatus according to the second embodiment is to flood the dry gas chamber with a substantially dry gas, preferably one of $CO_2$, dimethyl ether (DME), and one or combinations of substantially dry gases such as DME, $CO_2$, Solstice® L41 y (R-452B), Solstice® 452A (R-452A), Solstice® L40X (R-455A), Solstice® zd, Solstice® ze, (R-1234ze), Solstice® yf (R-1234y). The dry gas is filled by simply blowing it at a low flow rate through the granules of the endothermically reacting chemical compounds to replace any air that fills the interstitial spaces between the granules of the endothermically reacting chemical compounds. The next step is to thermally seal the dry gas chamber by heat sealing the open end of the blow spout to form a closed dry gas chamber and to form the completed cooling assembly shown in FIG. 10.

A standard beverage container is provided in the form of a conventional metal can or in the form of a plastic bottle.

The cooling assembly comprising the humidification liquid chamber, the dry gas chamber contents and the interconnection structure with the compressible plug member separating the two is then inserted into the beverage container. Carbonated beverage is then filled into the beverage container by conventional means. A beverage container lid with a beverage container opening means is provided for sealing off the beverage with the cooling assembly to form the apparatus according to the first embodiment.

When the beverage container is closed and sealed by the beverage container lid, carbonation pressure builds up within the container and around the cooling assembly. The carbonation pressure of the beverage compresses the humidification liquid chamber and the dry gas chamber and the interconnection structure until the internal pressure of the humidification liquid chamber and the dry gas chamber equals the carbonation pressure. The carbonation pressure also deforms and compresses the interconnection structure and the compressible plug member within the interconnection structure to smaller cross-sectional areas than the starting cross-sectional area while the compressible plug member maintains a sealing configuration. The apparatus is now ready for use.

Method of Operation of the Second Embodiment of the Invention

Upon opening the beverage container opening means, the change in carbonation pressure causes the interconnection structure to expand at least to some extent and preferably to its original state leaving the compressed compressible plug member at the smaller cross-sectional area. The difference in dimensions between the final compressed state of the compressible plug member and the starting uncompressed state of the compressible plug member must form a gap that permits fluid communication between the dry gas chamber and the humidification liquid chamber. The stages of compression and area reductions are shown in FIG. 5. Dry gas absorbs humidification liquid, forming a vacuum and pulling humidification liquid into the dry gas chamber. The humidification liquid chamber collapses by the contraction of the bellows to accommodate its new volume. Some humidification liquid vapor is evaporated during this process as well. The endothermically reacting chemical compounds react with the humidification liquid and dissolve endothermically to cool the beverage product. The solvation causes a further reduction in volume of the humidification liquid chamber and this causes the walls of the humidification liquid chamber to further collapse to permit more humidification liquid and humidification liquid vapor to be pulled into the dry gas chamber. Thus a complete dissolving of the endothermically reacting chemical compounds occurs and cooling of the beverage product occurs and the entire cooling occurs in contact with the maximum area available in both chambers throughout the cooling process. It is important that the surface areas of the humidification liquid chamber and the dry gas chamber be respectively maximized for best cooling. As such, the apparatus of this embodiment can be constructed using metallized bags connected by the interconnection structure as described above and shown in the figures. It is also important to note that a compression tension of the humidification liquid chamber in a bellows form can be built into the bellows if it the bellows is formed in a closed minimal volume configuration and then expanded to fill the humidification liquid in it. Then, upon activation, the tension of the bellows can push humidification liquid into the dry gas chamber as well.

Method of Manufacture of the Third Embodiment of the Present Invention

A third embodiment of the invention is shown in FIG. 11-13.

In the third embodiment of the invention, the same elements used in the first embodiment are used to reconfigure another embodiment of the invention that uses telescoping cylindrical chambers instead of collapsible flexible-walled chambers to form a collapsible volume system. A standard beverage container is provided with a beverage lid and a beverage opening means containing a beverage that is carbonated and under pressure. The beverage container may be a metal can of standard conventional form or a plastic bottle of conventional form. The humidification liquid chamber and the dry gas chamber are provided within the sealed beverage container as described hereunder.

A thin cylindrical-walled humidification liquid chamber is provided. The humidification liquid chamber is configured as a cylindrical cup in the form of a tubular cup side wall terminating in a cup end wall and an opposing cup open end. Humidification liquid such as water is held within the humidification liquid chamber and a compressible plug member made from preferably a suitable deformable material which is one of non-resilient and only partially resilient, examples of which include deformable waxes, metals, rubbers and plastics, placed to seal off the humidification liquid chamber or the dry gas chamber, and fluidly isolate the humidification liquid chamber. This easily can be achieved by filling the humidification liquid chamber with water for example, heating the water, and melting a suitable wax over the water to form a wax seal layer. When the wax dries, it forms a hermetic seal over the humidification liquid and seals off the open end of the humidification liquid chamber.

Similarly, a dry gas chamber is provided comprising thin a cylindrical-walled container with an open end. The dry gas chamber contains crystalline forms of endothermically reacting chemical compounds such as potassium nitrate, potassium chloride and urea. Dry gas is flowed into the dry gas chamber to fill the interstitial spaces between the crystals of the endothermically reacting chemical compounds. When the humidification liquid chamber is slid telescopically into the dry gas chamber, the interconnection structure is placed over the assembly to hold the two chambers in place and to snugly and frictionally and sealingly connect them and to prevent them from sliding apart.

It is also important that the dry gas be chilled to a temperature that prevents fast pressure build up that can separate the two chambers before the beverage container is sealed off with the beverage container lid. The internal pressure of the dry gas will build up until it equilibrates with the beverage carbonation pressure. As such, the pressure of the dry gas as it heats up to room temperature and gasifies cannot exceed the carbonation pressure. The carbonation pressure compresses the interconnection structure and this compresses the compressible plug member to a smaller diameter than its starting diameter while in a sealing configuration.

The interconnection structure is preferably made in the form of one of a plastic sleeve and a rubber sleeve to tightly and slidingly connect to and to seal off the open ends of the dry gas chamber and the humidification liquid chamber. The open end of the dry gas chamber preferably is made to snugly and sealingly slide over the plugged end of the humidification liquid chamber. Thus when the humidification liquid chamber is sealingly slid into the dry gas chamber, the reduced combined volume of the two chambers will preferably be made to equal to the volume of the dry gas chamber only. The entire cooling assembly can be left to just float inside the beverage container in the beverage, and alternatively the cooling assembly may also be affixed to the beverage container inner wall at any place or orientation.

When the beverage container is filled and sealed off as before by the beverage container lid, carbonation pressure builds up internally within the beverage container. The carbonation pressure compresses the interconnection structure and causes the dry gas chamber wall and the humidification liquid chamber wall to compress around the compressible plug member until the internal pressure of the humidification liquid chamber and the dry gas chamber equals the carbonation pressure. The cross-sectional area of the compressible plug member reduces due to carbonation pressure compression.

Method of Use of the Third Embodiment of the Present Invention

Upon opening the beverage container opening means, the change in carbonation pressure causes the interconnection structure to relax its pressure compression that is transmitted to the compressible plug member. The compressible plug member remains in a deformed smaller cross-section and the difference in dimensions between the final compressed state of the compressible plug member and the starting uncompressed state of the compressible plug member permits fluid communication between the dry gas chamber and the humidification liquid chamber, and the dry gas starts to absorb humidification liquid, forming a vacuum and pulling humidification liquid into the dry gas chamber. The humidification liquid chamber is pulled further into the dry gas chamber by the generated vacuum. Some humidification liquid vapor is evaporated during this process as well. The endothermically reacting chemical compounds react with the humidification liquid and dissolve endothermically to cool the beverage product. The solvation causes a further reduction in volume of the dry gas chamber and this causes more humidification liquid and humidification liquid vapor to be pulled into the dry gas chamber. Thus a complete dissolving of the endothermically reacting chemical compounds occurs and cooling of the beverage product occurs. It is important that the surface areas of the humidification liquid chamber and the dry gas chamber be respectively maximized for best cooling.

BRIEF DESCRIPTION OF THE DRAWINGS

Various other objects, advantages, and features of the invention will become apparent to those skilled in the art from the following discussion taken in conjunction with the following drawings representing the preferred embodiments of the invention, in which.

DETAILED DESCRIPTION OF THE INVENTION

Figure 1:
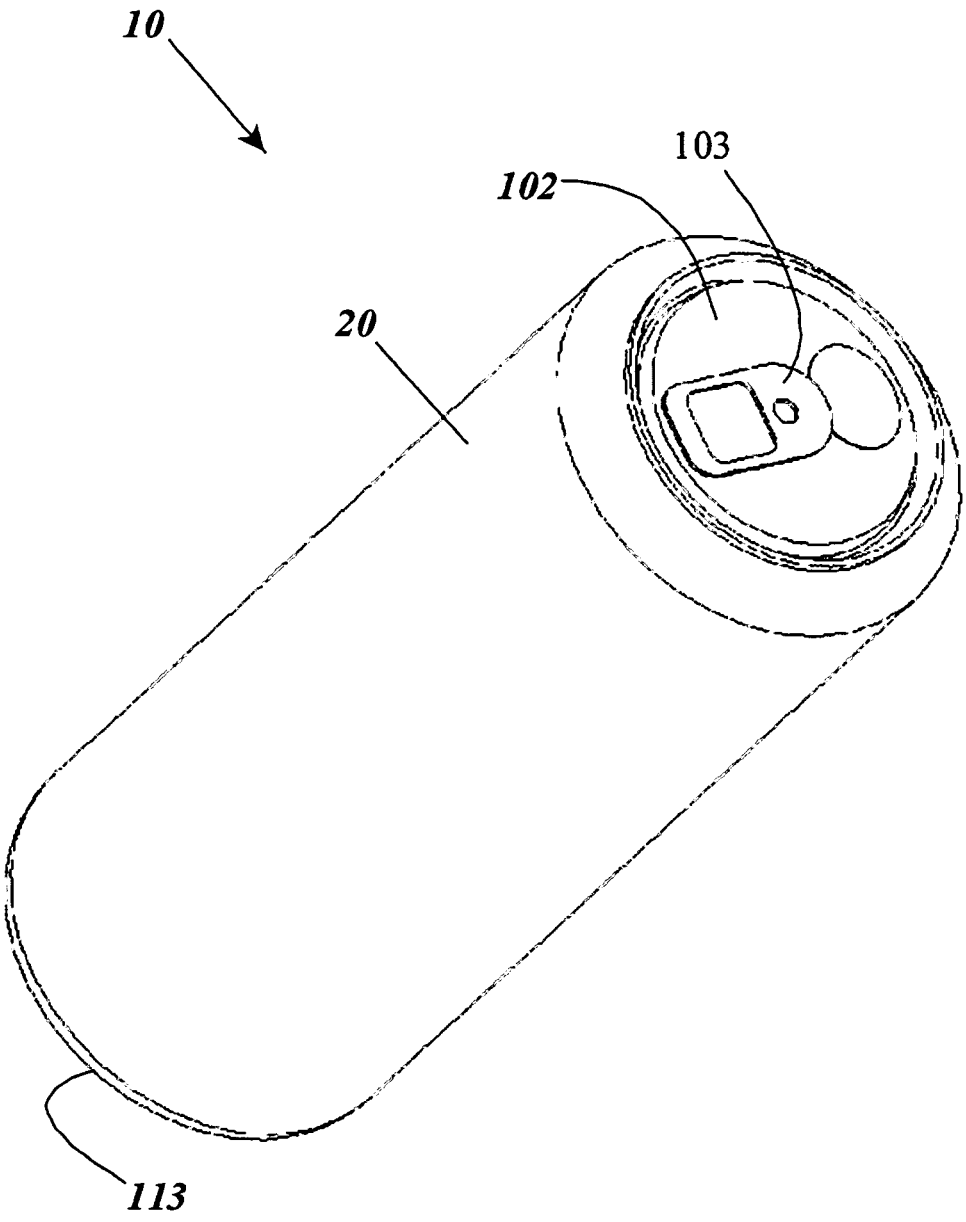
FIG. 1 shows the apparatus according to the embodiments of the invention. A metal beverage container is shown with a beverage container lid and beverage container opening means.
Figure 2:
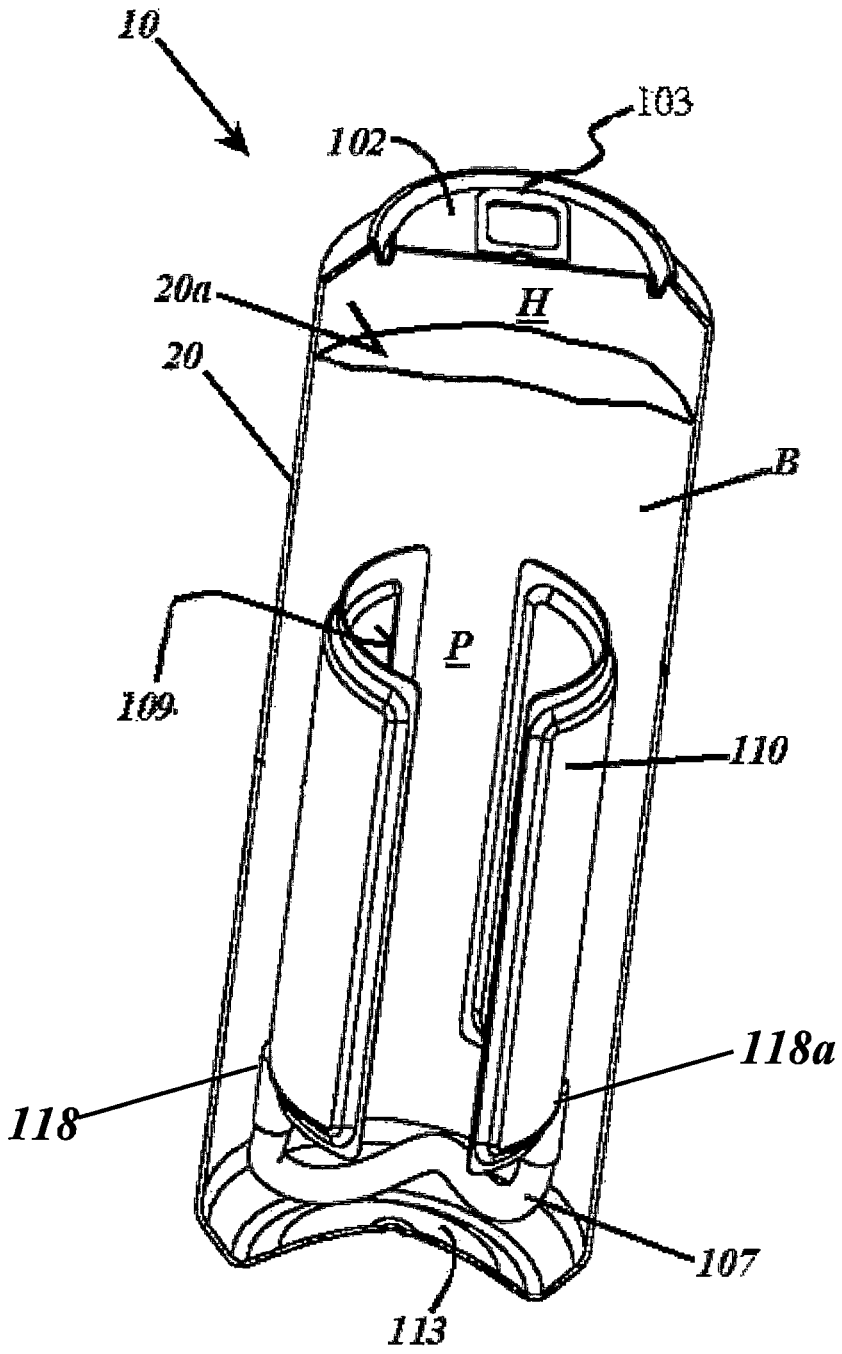
FIG. 2 shows the apparatus according to the first embodiment of the invention. A cut away view of a beverage container is shown within which is the cooling assembly comprising a humidification liquid chamber containing a humidification liquid, a dry gas chamber containing a dry gas and endothermically reacting chemical compounds. The dry gas chamber and the humidification liquid chamber are shown as thin bags separated by a flexible interconnection structure made from either a plastic or metal that is compressible by carbonation pressure. A compressible plug member fills, abuts and seals the interconnection structure and carbonation pressure acting on the interconnection structure keep it in a compressed sealing configuration to form a fluid seal between the dry gas chamber and the humidification liquid chamber.
Figure 3:
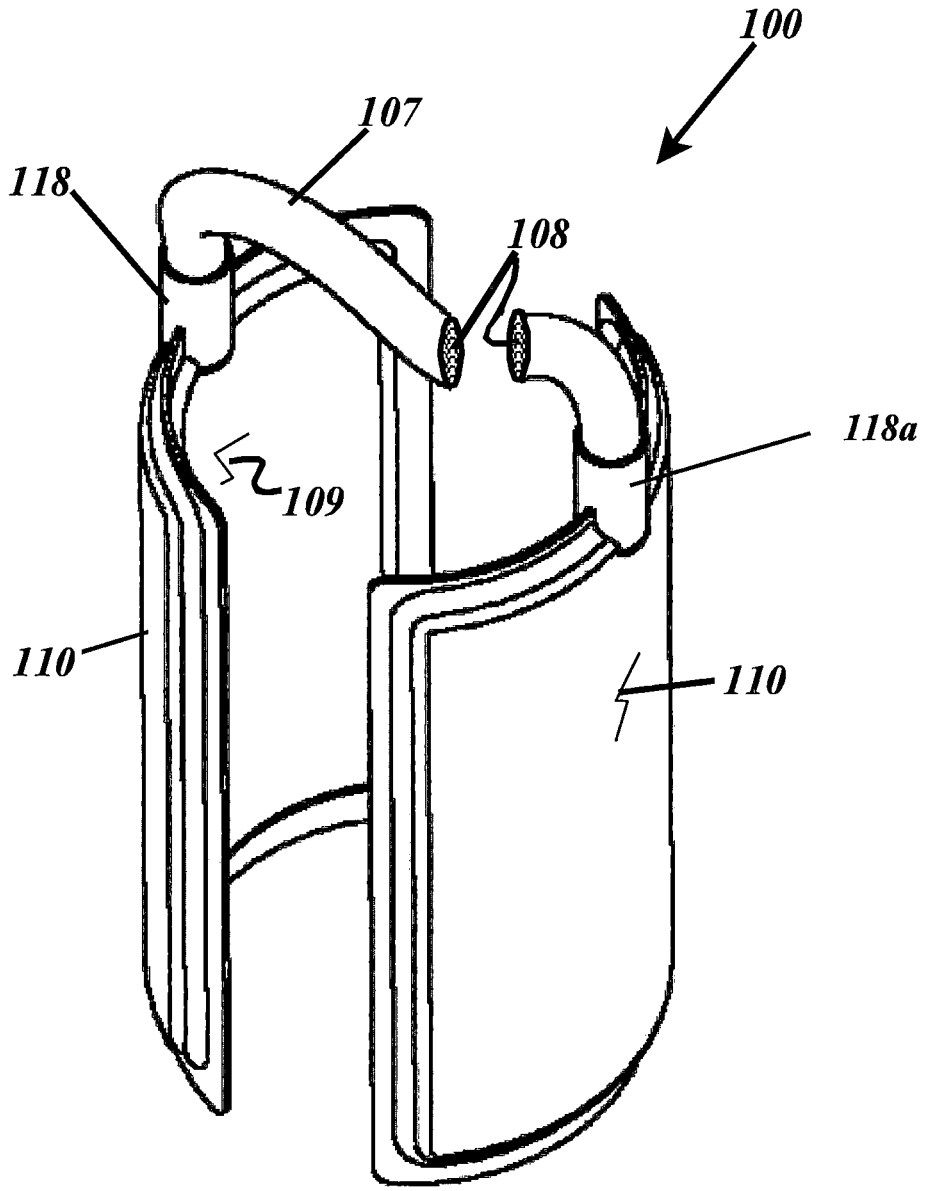
FIG. 3 the cooling assembly of the apparatus which shows a cut off cross-section of the interconnection structure with the compressible plug member filling the interconnection structure that connects the humidification liquid chamber and the dry gas chamber according to the first embodiment of the invention. The configuration shows the apparatus before the beverage container is opened. The humidification liquid chamber made in the form of a flexible bag container sealingly connected to the interconnection structure and the dry gas chamber is also shown made in the form of a flexible bag that is sealingly connected to the interconnection structure. Note that the interconnection structure is shown filled with the compressible plug member which may be a wax or a putty that is deformable by pressure.
Figure 4:
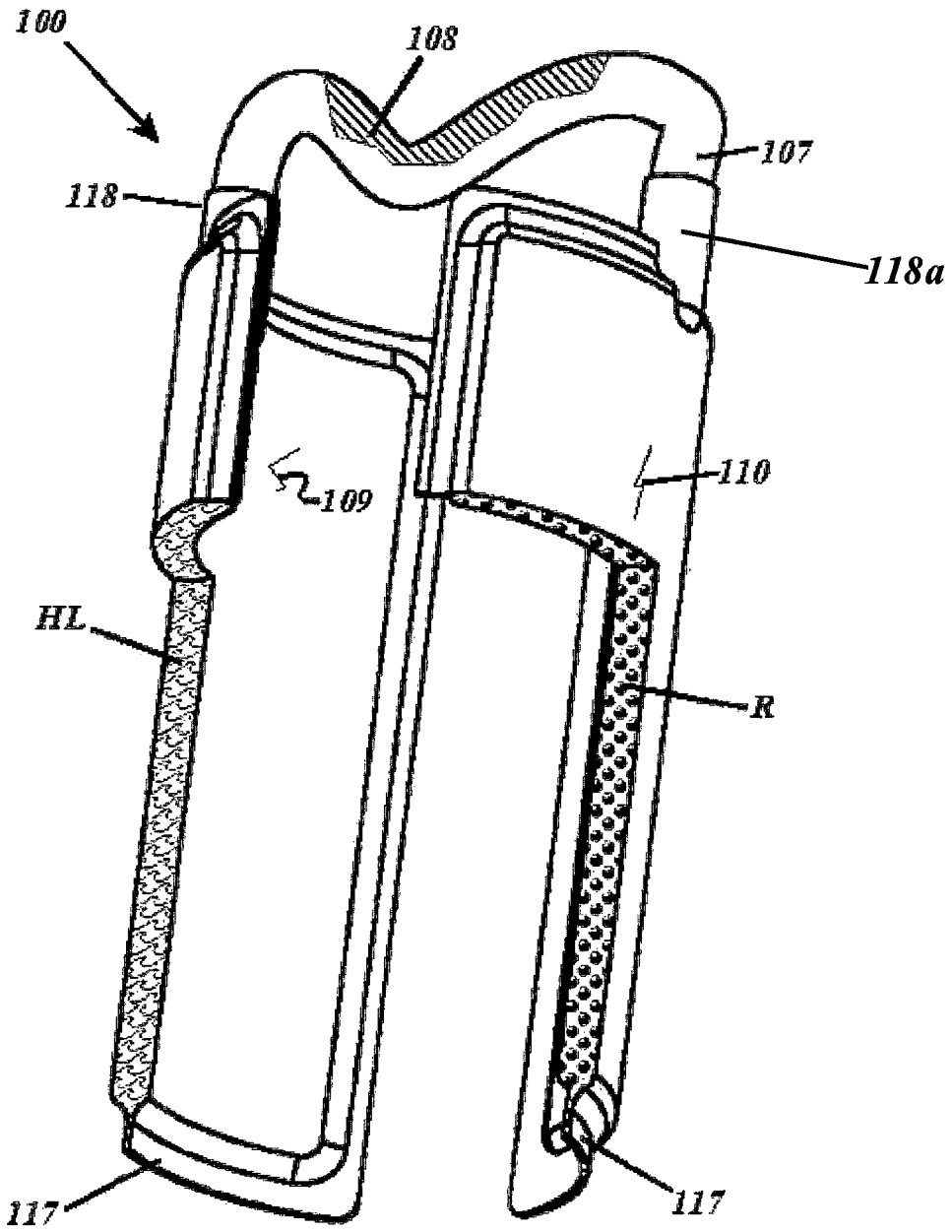
FIG. 4 also shows the same configuration of the cooling assembly of the apparatus which shows a portion of the interconnection structure removed to reveal the compressible plug member filling the interconnection structure. A cut away section of the humidification liquid chamber shows the humidification liquid within the humidification liquid chamber and a cut away section of the dry gas chamber shows the dry gas and the endothermically reacting chemical compounds within the dry gas chamber.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

For orientation purposes and clarity, the food product container is assumed to be standing in a vertical orientation and thus in its normal placement orientation. This invention uses the thermodynamic potential of the evaporation of a humidification liquid, such as water or other suitable liquid, and the ability of a substantially low vapor pressure medium such as a dry gas DG to force this evaporation from even cold liquids.

Method of Manufacture of the First Embodiment of the Present Invention

A first embodiment of the invention is shown in FIGS. 1-10. In the first embodiment, a cooling assembly 100 comprising an elongate vessel with thin walls in the form of a thin plastic lay-flat tubing 105 with a vessel first end segment and a vessel middle segment and a vessel second end segment formed using thin walled lay-flat tubing 105. A humidification liquid chamber 104 comprises the vessel first end segment sealed to contain a humidification liquid HL. The humidification liquid chamber wall 109 sealingly connects to the vessel middle segment to form a chamber interconnection structure 107. The chamber interconnection structure 107 sealing connects to the vessel second end segment which forms a dry gas chamber wall 110 that extends to form a dry gas chamber 106 which is sealed and contains endothermically reacting chemical compounds and a dry gas DG. The interconnection structure 107 is in the form of the thin wall that spans between the dry gas chamber wall 110 and the humidification liquid chamber wall 109. The interconnection structure 107 has an initial cross-sectional area and is made from materials that are one of resilient and partly resilient plastics, metallized plastics and thin foils. A compressible plug 108 which is made from one of non-resilient and partly resilient materials such as putty, plastic, metal, cork, closed foam, and wax is contained within the interconnection structure 107 to sealingly abut the interconnection structure 107, to form a fluid seal against the passage of humidification liquid from the humidification liquid chamber 104 to the dry gas chamber 106 while subjected to the container internal pressure P created by said carbonated beverage B.

Figure 7:
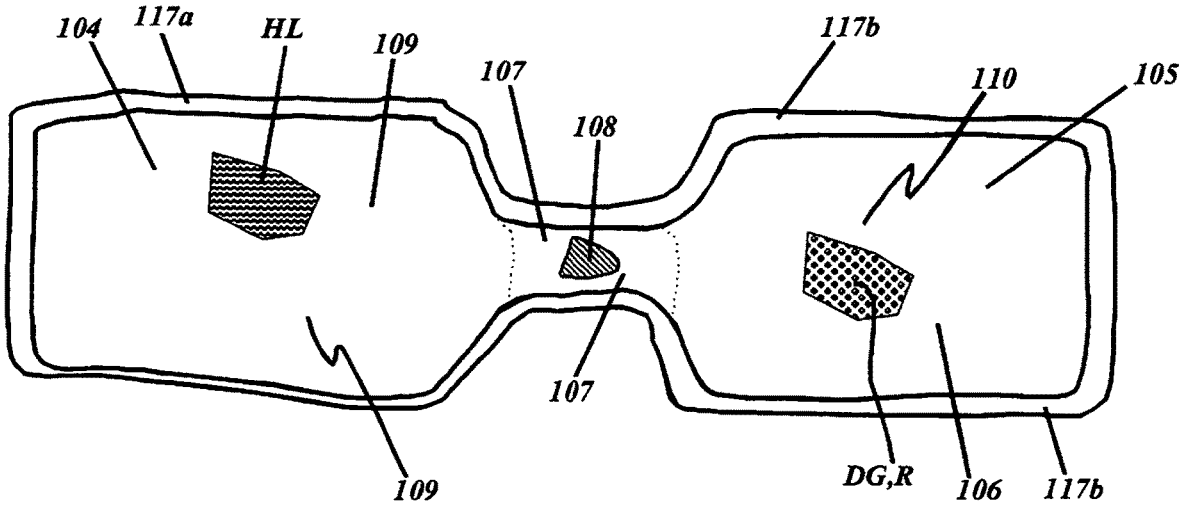
FIG. 7 shows the first embodiment in the simplified form floating in a beverage contained inside a sealed carbonated beverage container.
Figure 7A:
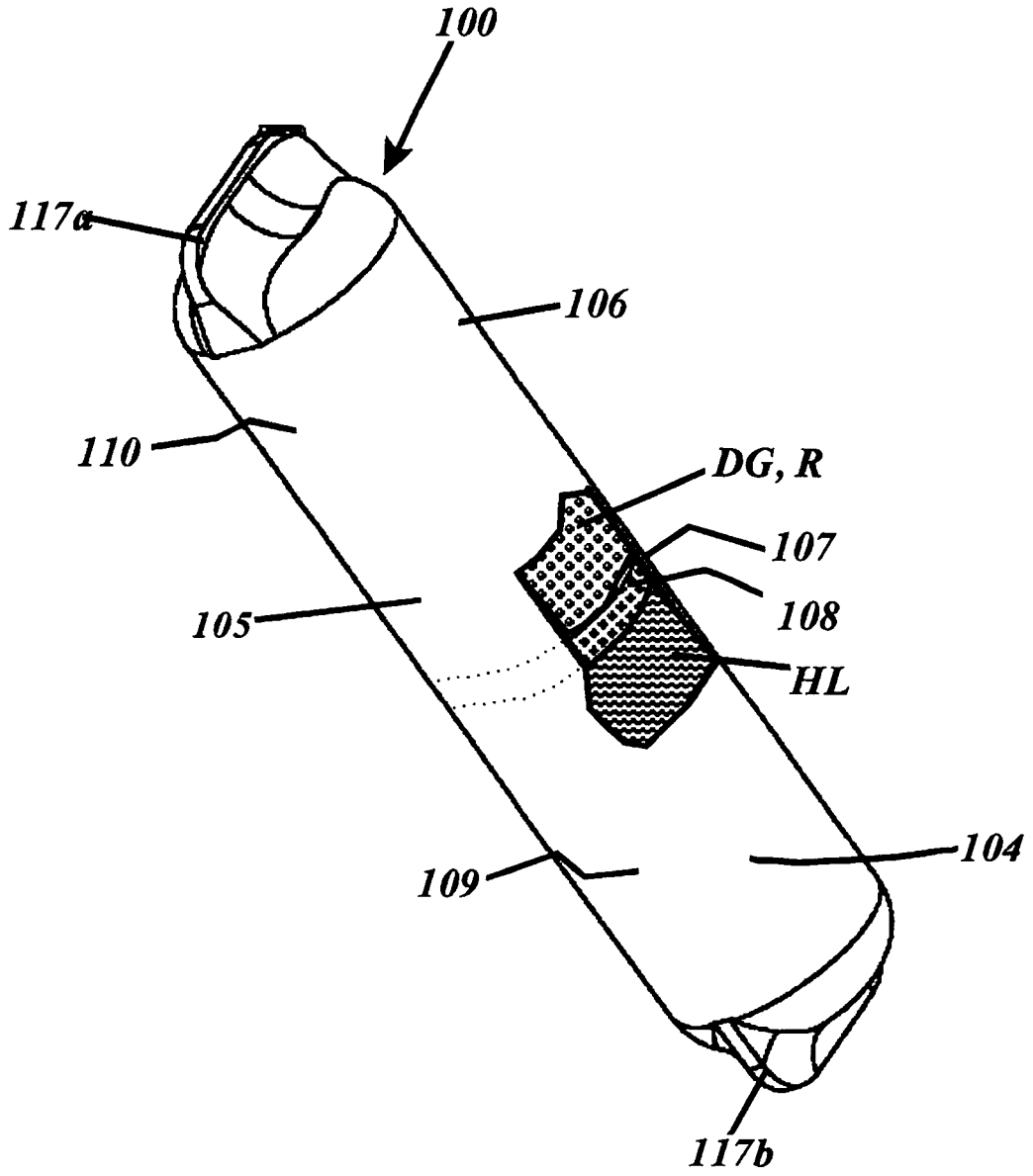
FIG. 7*a* shows a simple version of the cooling assembly of the apparatus as a simple tube with sealed ends without the need for the narrow neck forming a smaller interconnection structure.
Figure 7B:
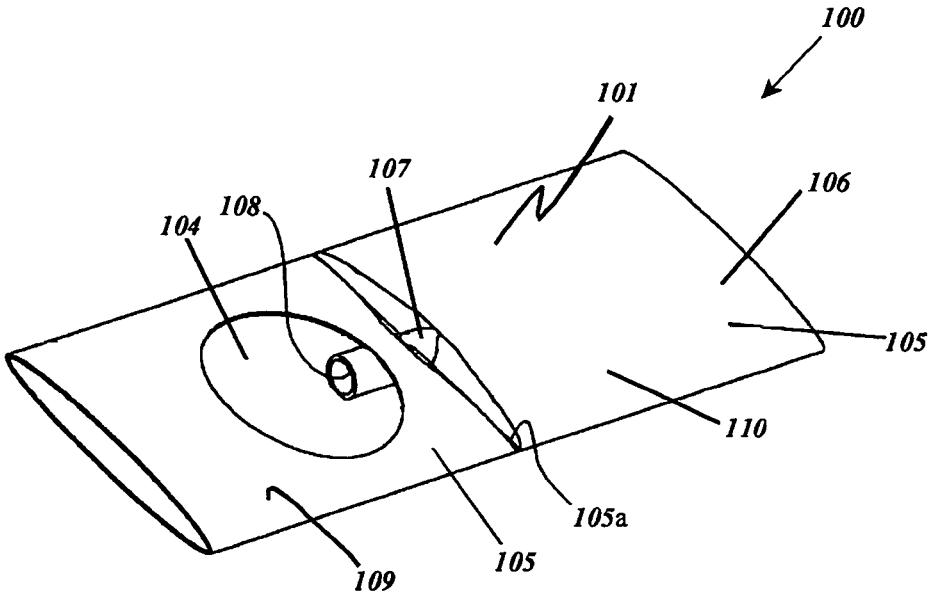
FIG. 7*b* shows another simple version of the cooling assembly of the apparatus formed as a lay-flat bag.
Figure 8:
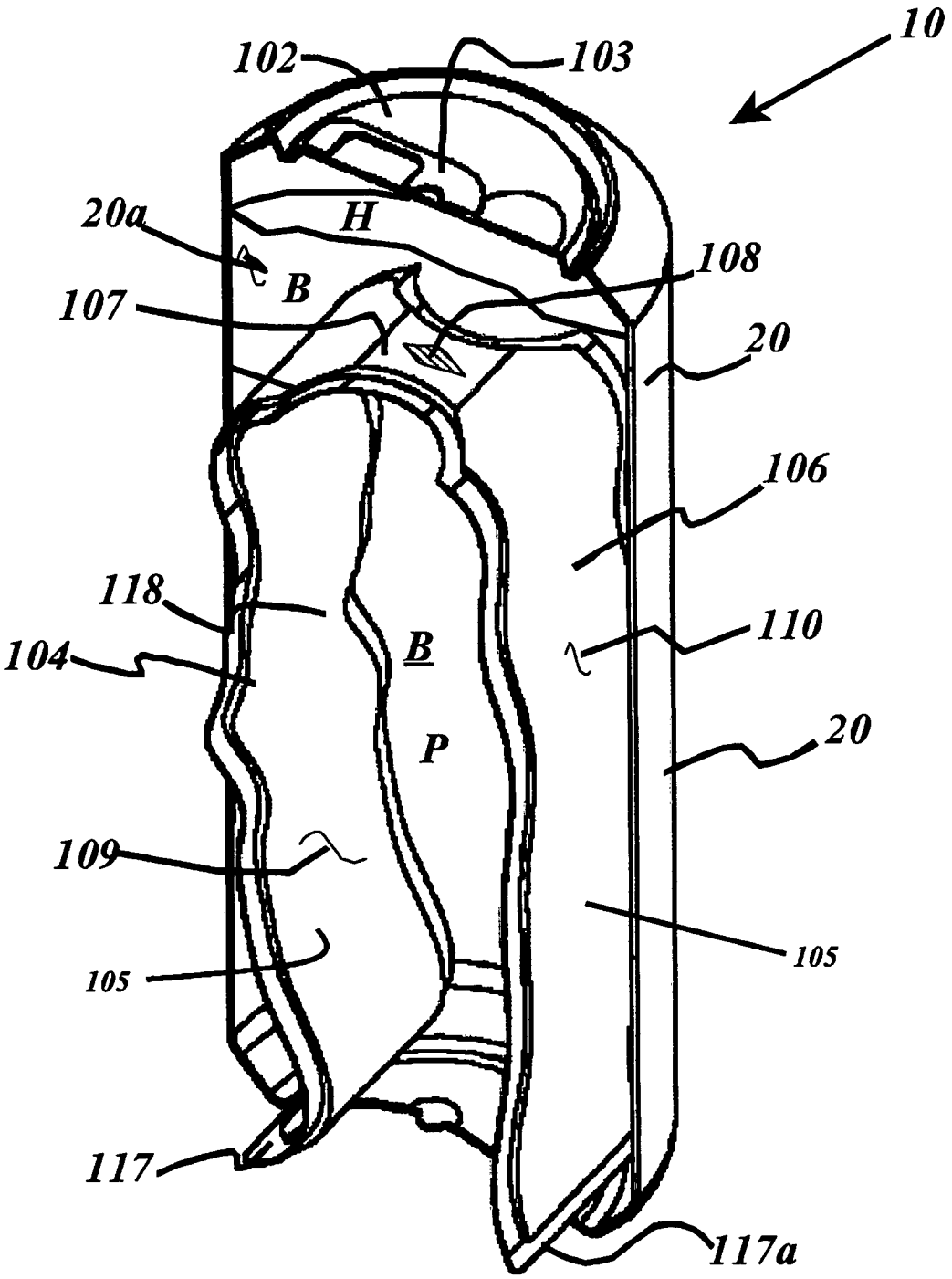
FIG. 8 shows a simplification of the interconnection structure as being constructed from the same lay-flat bag materials as the dry gas chamber and the humidification liquid chamber. The interconnection structure for this embodiment, is simply a narrow neck connecting the humidification liquid chambers and the dry gas chamber and is filled with the compressible plug member material before the humidification liquid and the dry gas chamber are heat sealed with their respective contents of humidification liquid and dry gas with endothermically reacting chemicals respectively.
Figure 9:
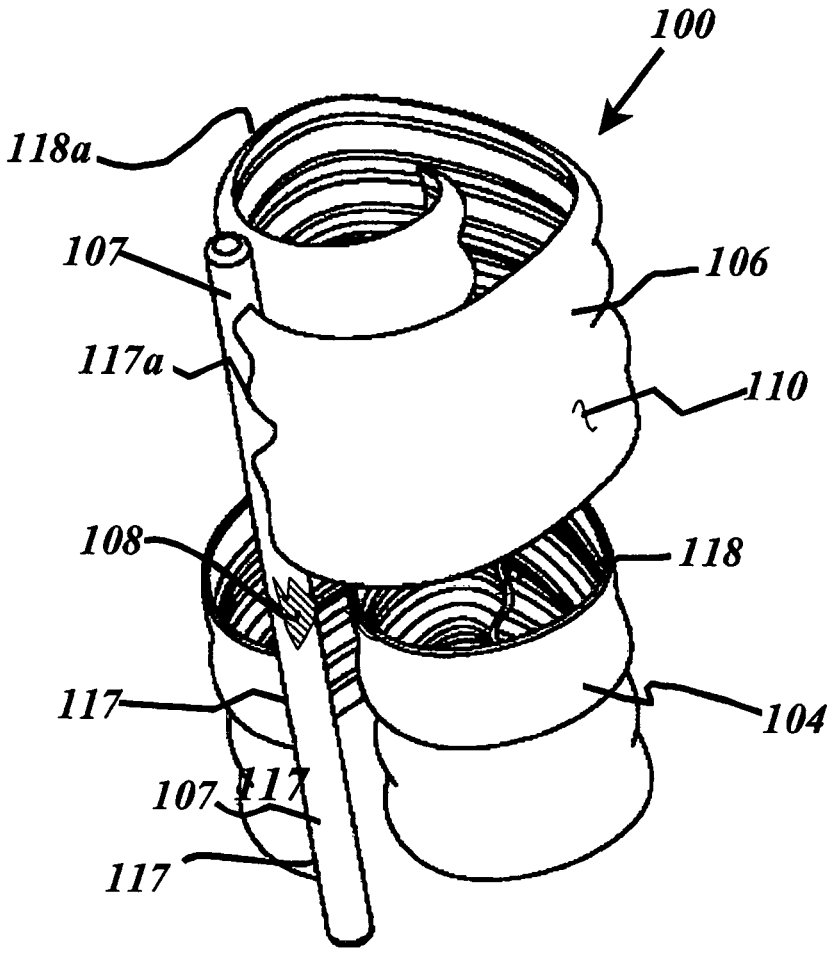
FIG. 9 shows a configuration of the first embodiment of the invention with the humidification liquid chamber and the dry gas chamber connected by the interconnection structure in a spiral configuration on the interconnection structure.

In one preferred method of manufacture of the first embodiment, a humidification liquid chamber 104, a dry gas chamber 106 and the interconnection structure 107 are provided in the form of a contiguous flexible and collapsible structure such as a lay-flat tubing preferably in the form of metalized lay-flat tubing 105. A lay-flat-tube 105, preferably with an expanded diameter of about 2-3 inches and about 8-12 inches long, is first provided with open ends. In one embodiment as shown in FIG. 7*b*, the lay-flat tubing 105 has a heat-sealed middle segment 105*a* that forms a seal around the interconnection structure 107 to form a humidification liquid chamber 104, a dry gas chamber 106. As shown in FIG. 7, the interconnection structure 107 may be required to have a small cross-sectional area, and thus can be reshaped and formed by heat sealing a narrow neck portion centered on the lay-flat tubing 105's length and width to form the interconnection structure 107 with the two open ends of the lay-flat tubing 105 forming open ends for the humidification liquid chamber 104 and the dry gas chamber 106 respectively. This can be achieved, for example, by heat sealing edges 117 and heat sealing edges 117*a* to form a narrow neck portion to form the interconnection structure 107 as shown in FIG. 7. The cooling assembly 100 comprising the humidification liquid chamber 104, the dry gas chamber 106 and the interconnection structure 107 thus formed preferably are made from a thin-walled, flexible and compressible elastic lay-flat tubing 105 material such as one of PET, PVC, Polyethylene, and Polycarbonate, for example. Preferably, the lay-flat tubing 105 material used is made from substantially impervious film materials that prevent to a great extent beverage and carbonation from passing through its walls. Thus when the formed cooling assembly 100 described above is expanded into its full diameter, an open ended humidification liquid chamber 104 is formed and an open ended dry gas chamber 106 is formed and both chambers are connected by a narrow neck forming the interconnection structure 108.

Figure 14:
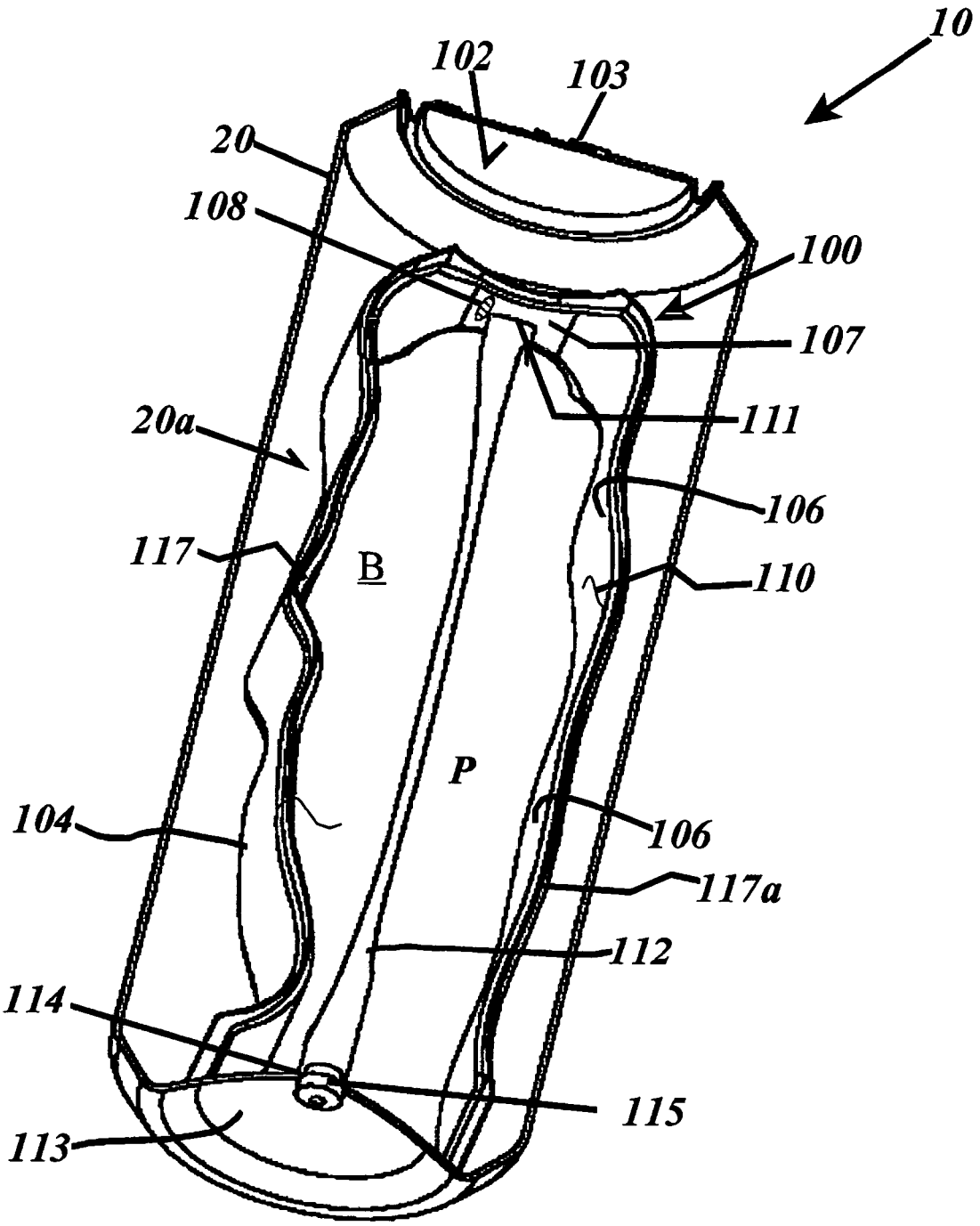
FIG. 14 shows the fourth embodiment of the invention with the Tee-connector and the interconnection structure formed as a single piece together with the dry gas chamber and the humidification liquid chamber. A small cut out of the interconnection structure shows the compressible plug member structure sealing off the humidification liquid chamber of the apparatus.
Figure 15:
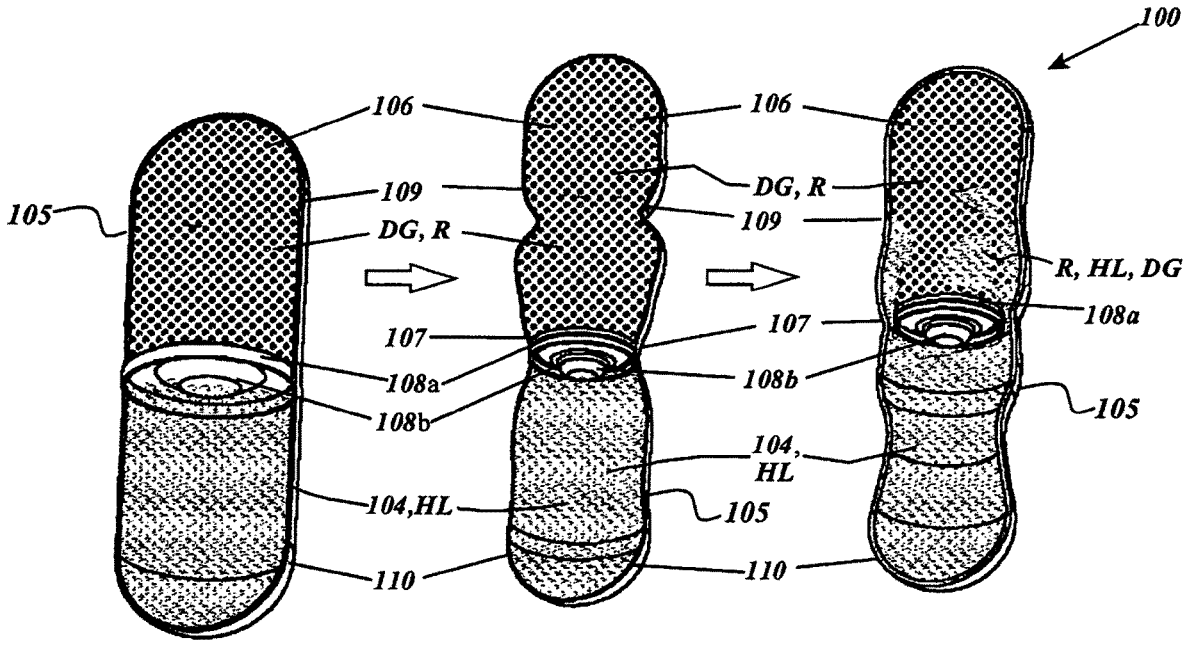
FIG. 15 shows the first embodiment of the invention, with the interconnection structure being part of the unified body of the dry gas chamber and the humidification liquid chamber. The figure shows the three stages of the actions on the cooling assembly with a first stage showing the cooling assembly unaffected, then a second stage showing carbonation pressure compressing the cooling assembly, and a third stage showing the release of carbonation pressure causing an expansion of the cooling assembly walls forming a passageway for humidification liquid to enter into the dry gas chamber.
Figure 16:
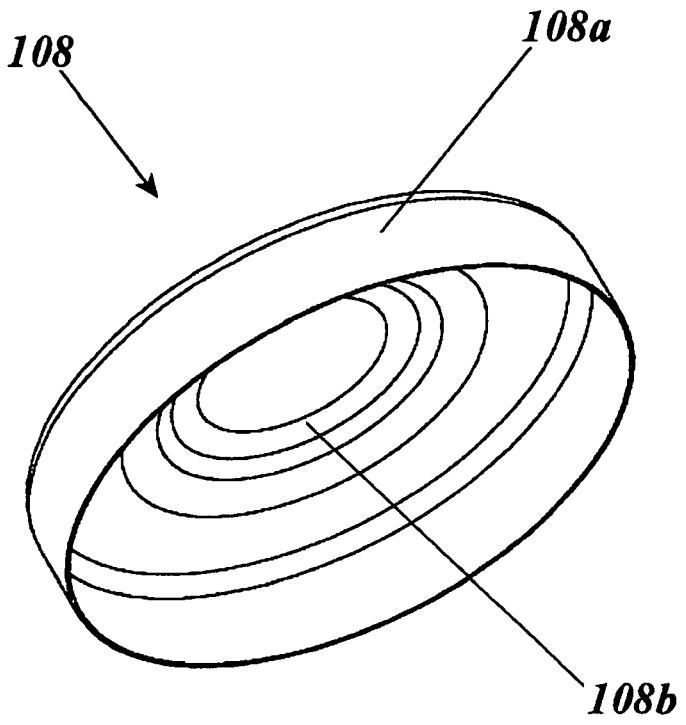
FIG. 16 shows the compressible plug made from a combination of a partly resilient material such as plastic and metal with a central deformable membrane. When carbonation pressure rises, the pressure compresses the interconnection structure which then compresses the compressible plug to a smaller diameter while maintaining a sealing configuration.

As shown in FIGS. 15-16, a compressible plug member 108*a* can also be made from one of a deformable and compressible plug ring 108*a* made from one of a thin metal or plastic, with a thinner collapsible membrane portion 108*b* in the form of a disc. As long as the diameter of the compressible plug member 108 can be shrunk irreversibly or only partially reversibly shrunk from its original diameter, the material of the collapsible membrane portion 108*b* will collapse and permit only partial or no return of the compressible plug ring 108*a* to its original cross-sectional area. Thus materials such as flexible low density polyethylene and flexible PVC, aluminum, and PET, that can be irreversibly compressed or only partially reversibly compressed by pressure to a smaller diameter in cross-sectional area may be used. Thus the compressible plug ring 108*a* seals and separates the humidification liquid chamber 104 from the dry gas chamber 106 before and during storage of the apparatus 10 in its final form. The interconnection structure 107 may be incorporated as a portion of the cooling assembly 100 wall to sealingly connect the dry gas chamber 106 to the humidification liquid chamber 104. Alternatively, the narrowing of the lay-flat tubing 105 to form a narrow neck for a smaller interconnection structure 107 is only necessary if the amount of material used to form the compressible plug member 107 needs to be reduced to minimize its thermal penalty on the cooling capacity of the apparatus 10. Thus the cooling assembly 100 also may be formed from a single unaltered tubular bag material as shown in FIGS. 7, 7*a*, 7*b*, 14 and 15. Then, advantageously, only the open ends of the bag forming the humidification liquid chamber 104 and the dry gas chamber 106 need to be heat sealed during construction of apparatus 10.

Figure 17:
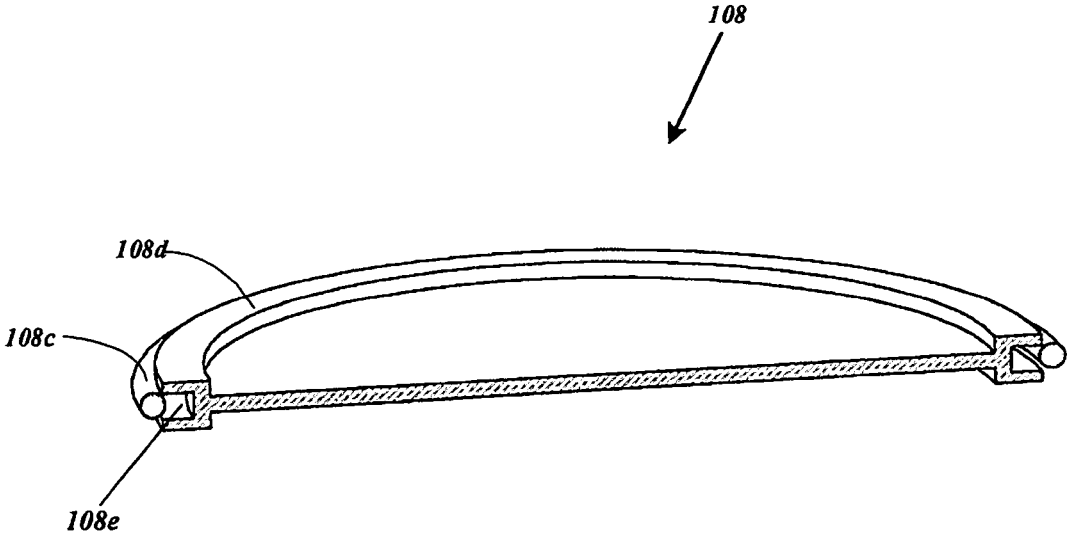
FIG. 17 shows yet another way the compressible plug may be constructed using a combination of a partly resilient O-ring made from materials such as plastics, rubbers, and metals, held in an O-ring grove on a thin disc. The O-ring grove is designed to tightly hold the O-ring at a smaller diameter when it is compressed by pressure by the interconnection structure, such the O-ring does not re-expand back to a larger diameter when the compressing carbonation pressure is released.
Figure 18:
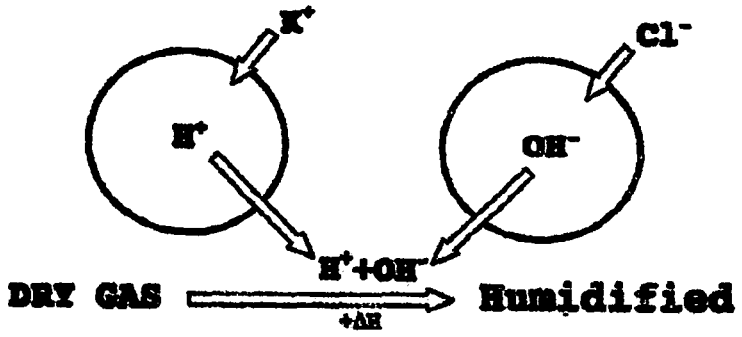
FIG. 18 is a schematic image illustrating an example of the direct transfer of the bond energies from broken humidification liquid molecules to the reformation energy of humidification liquid vapor as a vapor that is immediately transported away or absorbed by dry gas humidification and taken away, where the humidification liquid is water.

As shown in FIG. 17, a compressible plug member 108*c* can also be made in the form of an 108*c* from a material that is one of deformable and compressible, such as (but not limited to) one of rubber, cork, closed foam, rubber, putty, plastic, metal, and wax with a non-compressible disc membrane portion 108*d* in the form of a disc with an O-ring grove. Compressible plug member 108*c* is made to fit sealingly tight in an O-ring grove 108*e* on the periphery of disc membrane portion 108*d*. When pressure is applied to the compressible plug member 108*c* it is compressed to a smaller diameter into the grove 108*e* on the periphery of disc membrane portion 108*d* where it is held in the tight configuration such that it does not re-expand back to its original diameter. As long as the diameter of the compressible plug member 108*c* can be shrunk irreversibly or only partially reversibly shrunk from its original diameter, the tightness of the O-ring groove 108*e* will permit only partial or no return of the compressible plug ring 108*a* to its original cross-sectional area. Thus when carbonation pressure P, builds up against the interconnection member 107, the interconnection member 107 compresses the compressible plug member 108*c* into the grove 108*e* on the periphery of disc membrane portion 108*d* to a smaller diameter, where it is held at the smaller diameter in the tight sealing configuration against the interconnection member 107 and the disc membrane portion 108*d* such that it does not re-expand back to its original diameter when the same pressure is removed. It is important that the grove 108*e* on the periphery of disc membrane portion 108*d* must be made to tightly and frictionally hold the compressible plug member 108*c* in a sealing configuration with the disc membrane portion 108*d* and the interconnection member 107 when carbonation pressure P builds up and compresses the interconnection member 107 to a smaller cross-sectional area. However, upon release of the carbonation pressure, it is important that the grove 108*e* on the periphery of disc membrane portion 108*d* be made to still tightly and frictionally hold the compressible plug member 108*c* at its smaller compressed diameter and not permit the same to re-expand back to its original uncompressed starting diameter when carbonation pressure P is released and the interconnection member 107 expands back to its original cross-sectional area.

The next step in manufacturing the apparatus 10 is filling the dry gas chamber 106 with granular forms of the endothermically reacting chemical compounds R through its open unsealed end. The endothermically reacting chemical compounds R should be made to fill and contact the maximum possible surface area of the dry gas chamber walls 110. Of course, while the surface area of the dry gas chamber 106 is fixed by the lay-flat tubing 105 material area available to form the dry gas chamber 106, the volume of the dry gas chamber 106 depends on the extent to which the lay-flat tubing 105 that forms the dry gas chamber 106 is expanded. Advantageously any volume between the maximum expanded volume and the minimum lay-flat volume of the two chambers can be accommodated in the same surface area of the dry gas chamber 106.

A further step is making a cooling assembly 100 of the invention is to fill the interconnection structure 107 between the humidification liquid chamber 104 and the dry gas chamber 106 with a compressible plug member 108. The compressible plug member 108 is preferably made from a suitable deformable material, one of non-resilient and only partially resilient material such as a non-water-soluble wax, a rubber, cork, closed foam, a plastic, and a putty. In FIGS. 15 and 16, an example of a compressible plug member 108 made from a metal or plastic ring is shown. The compressible plug 108 is shown made as a compressible ring 108*a* with a collapsible membrane 108*b*. Compressible ring 108*a* is simply placed to fit tightly and sealingly against the interconnection structure which in this case is just the wall portion that interconnects the dry gas chamber 106 and the humidification liquid chamber 104. Compressible ring 108*a* is designed and made to fluidly seal between the two chamber and also separate the two chambers.

The compressible plug member 108 is placed to sealingly fill either a portion or the entire interconnection structure 107 to separate the dry gas chamber 106 from the humidification liquid chamber 104. The compressible plug member 108 can also be made as one of a deformable metal and plastic disc such that the disc can irreversibly deform in cross-section when compressed by beverage pressure acting against the interconnection structure 107. Thus the compressible plug member 108 is made from materials that fluidly seal and separate the humidification liquid chamber 104 from the dry gas chamber 106. The interconnection structure 107 sealingly connects the dry gas chamber wall 110 to the humidification liquid chamber wall 109. Both the dry gas chamber 106 and the humidification liquid chamber 104 can also be made as separate bags connected sealingly to the ends of the interconnection structure 107 by means of thermal welding. As shown in FIGS. 2, 3, 4 and 6, the interconnection structure 107, may also be made with any of several possible cross-sectional shapes to sealingly connect to the dry gas chamber wall 110 and the humidification liquid chamber wall 109 by means of an extended dry gas chamber tube 118*a* and a humidification liquid chamber tube 118 respectively. It is obvious that the interconnection structure 107 may be composed in sections that can be connected together for ease of assembly of the cooling assembly 100 as shown in FIGS. 2, 3, 4 and 6. Thus, the humidification liquid chamber 104 and the dry gas chamber 106 can be fluidly connected by the interconnection structure 107 with the compressible plug member 108 preventing any fluid communication between the two chambers to form a cooling assembly 100 of the apparatus 10.

Alternatively, the narrowing of the lay-flat tubing 105 to form a narrow neck for a smaller interconnection structure 107 is only necessary if the amount of material used to form the compressible plug member 108 needs to be reduced to minimize its thermal penalty on the cooling capacity of the apparatus 10. The cooling assembly 100 may also be formed from a single unaltered tube material as shown in FIGS. 7, 7*a*, 7*b*, 8, 14, and 15. Then, advantageously, only the open ends of the humidification liquid chamber 104 and the dry gas chamber 106 need to be heat sealed during construction of apparatus 10.

If lay-flat tubing 105 material that is used to form the cooling assembly 100 is too thin, i.e., in the order of magnitude of thickness less than 1 mil, a supporting flexible rubber tube segment may be added to form the interconnection structure 107 to permit the interconnection structure 107 to be compressible by carbonation pressure P to a smaller cross-sectional area, and also to permit the interconnection structure 107 to bounce back to its original shape when the pressure is released, using the rubber material's elasticity. Thus, the interconnection structure 107 may be made as a separate segment of the cooling assembly 100 as shown in FIGS. 2-6. The interconnection structure 107 may also be made separately from one of a rubber material and a plastic material that permits it to be substantially reversibly compressible by beverage carbonation pressure P to a smaller cross-sectional area, and yet permit it to bounce back to its original shape when the compressing carbonation pressure P is released. Alternatively, the interconnection structure 107 may be reinforced by one of, a rubber tube and a plastic tube, to permit it to bounce back to its original shape when deformed by beverage carbonation pressure P. The interconnection structure 107 may also be made from an elastic plastic such as a soft PVC, that can be compressed by the carbonation pressure P, and that will bounce back to its original cross-sectional area and shape when the beverage carbonation pressure P is released.

The next step in manufacturing the apparatus 10 is filling the dry gas chamber 106 with granular particles of the endothermically reacting chemical compounds R through its open unsealed end. The endothermically reacting chemical compounds R should be made to fill and contact the maximum possible surface area of the dry gas chamber wall 109. Of course, while the surface area of the dry gas chamber wall 109 is fixed by the lay-flat tubing 105 material's available area, the volume of the dry gas chamber 106 depends on the extent to which the lay-flat tubing 105 forming the dry gas chamber 106 can be expanded. Advantageously, both the dry gas chamber 106 and the humidification liquid chamber 104 can have any volume between the maximum expanded cylindrical volume of lay-flat tubing 105, and the minimum lay-flat volume of lay-flat tubing 105, while both chambers maintain a constant surface area respectively.

The next step is to flood the dry gas chamber 106 with a dry gas DG, preferably one of dry $CO_2$, dry dimethyl ether (DME), and one or combinations of DME, $CO_2$, Solstice® L41y (R-452B), Solstice® 452A (R-452A), Solstice® L40X (R-455A), Solstice® zd, Solstice® ze, (R-1234ze), and Solstice® yf (R-1234y). The dry gas DG is filled by simply blowing it at a low flow rate through the granules of the endothermically reacting chemical compounds R to replace any air that fills the interstitial spaces between the granules of the endothermically reacting chemical compounds R. The next step is to thermally seal the dry gas chamber 106 by heat sealing the open end of the dry gas chamber 106 to form a sealed chamber.

If the amount of dry gas DG needed exceeds the pressure rating of the dry gas chamber 106, a simple remedy is shown in FIG. 14 where it is anticipated that an extension Tee-connector tube 111 of the interconnection structure 107 may be added as an elongated this flexible tube 112 extending from the dry gas chamber 106 through a hole 114 through a wall of the beverage container 20 such as through the beverage container domed base 113, and sealed by a snap on fitting 115 to said hole 114. In such a case the extension flexible tube 112 will act as its own check-valve when carbonation pressure collapses said flexible tube and closes it off to permit only the dry gas DG to be forced into the dry gas chamber 106 from outside the beverage container 20 after the beverage container is sealed without loss of dry gas DG back to atmosphere. This extension flexible tube structure is only necessary if more dry gas DG is anticipated to be stored in the dry gas chamber 106 than can be supported by the dry gas chamber 106 without the support of equilibrating carbonation pressure acting on the dry gas chamber walls 109.

The next step in the assembly of the apparatus 10 is to fill the humidification liquid chamber 104 with humidification liquid HL. The humidification liquid HL must be chosen to react endothermically with the endothermically reacting chemical compounds R and to also evaporate when subjected to the dry gas DG. Preferably, the humidification liquid HL is water. The humidification liquid HL should contact the maximum possible surface area of the humidification liquid chamber 104 that is available. Of course while the surface area of the dry gas chamber 106 is fixed by the lay-flat tubing 105 material, the volume of the humidification liquid chamber 104 depends on the extent to which the lay-flat tubing 105 that forms the humidification liquid chamber 104 can be expanded. Advantageously any volume between the maximum expanded volume and the minimum lay-flat volume of the two chambers can be accommodated. The next step is to thermally seal the humidification liquid chamber 104 by heat sealing its open end to form a closed humidification liquid chamber 104.

A standard beverage container 20 is provided in the form of a conventional metal can or in the form of a plastic bottle. The cooling assembly 100 comprising the humidification liquid chamber 104, the dry gas chamber 106 and chamber contents, and the interconnection structure 107 with the compressible plug member 108 separating the two, is then inserted into the beverage container 20. Carbonated beverage B is then filled into the beverage container 20 by conventional means. A beverage container lid 102 with a beverage container opening means 103 is provided for sealing off the beverage with the cooling assembly 100 to form the apparatus 10 according to the first embodiment.

When the beverage container 20 is sealed off by the beverage container lid 102, carbonation pressure P builds up. The carbonation pressure P of the beverage B compresses the humidification liquid chamber 104 and the dry gas chamber 106 and the interconnection structure 107 until the internal pressure of the humidification liquid chamber 104 and the dry gas chamber 106 equals the carbonation pressure P. The carbonation pressure P also deforms the interconnection structure 107 and compresses the interconnection structure 107 and the compressible plug member 108 to a smaller cross-sectional area than their starting cross-sectional areas while the compressible plug member 108 still remains in a sealing configuration. The apparatus 10 is now ready for use.

Method of Operation of the First Embodiment of the Invention

Figure 5:
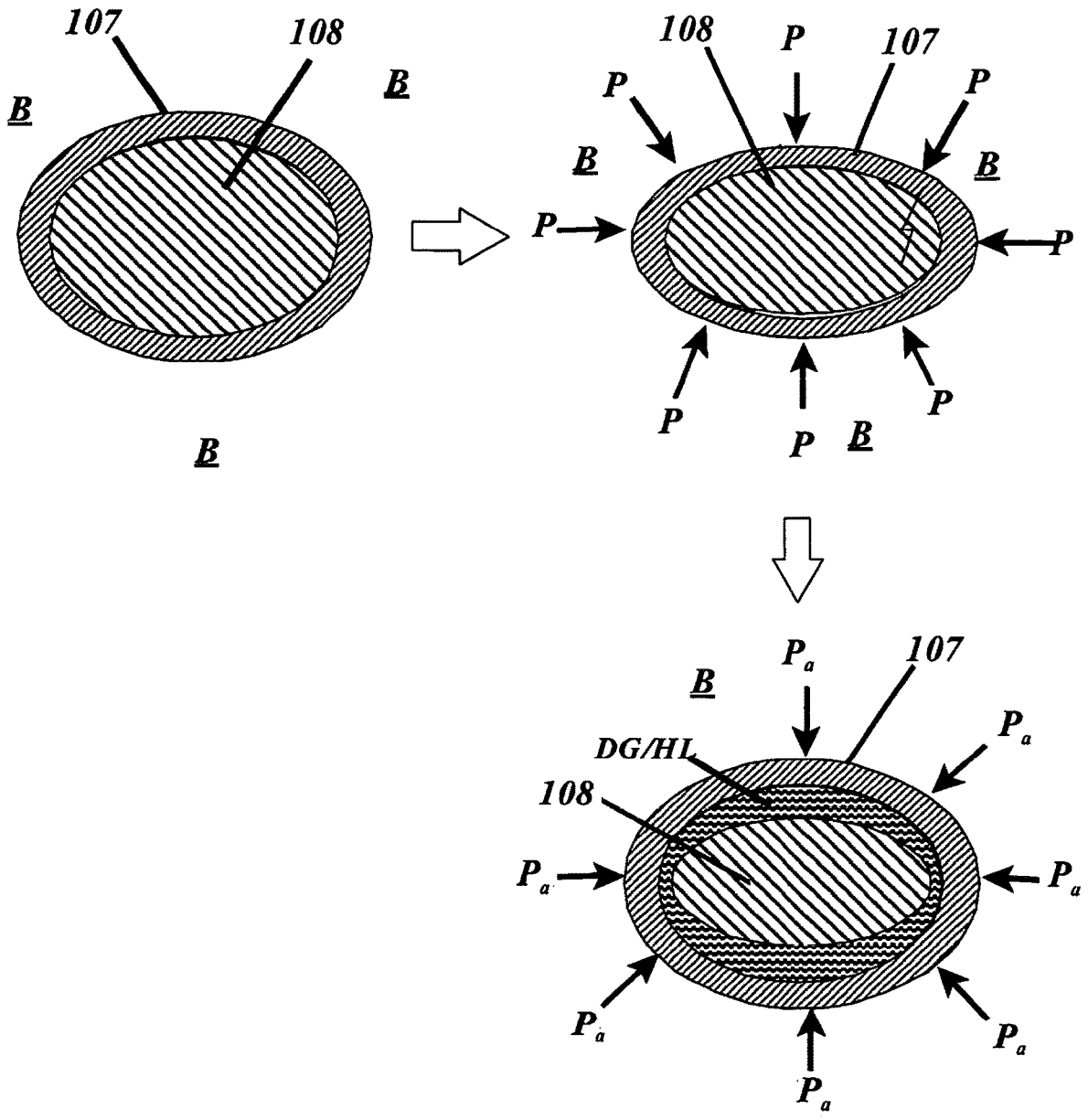
FIG. 5 shows a cross-section of interconnection structure in different stages of operation. The arrows show the stages of actuation as the interconnection structure is compressed by carbonation pressure to a smaller cross-sectional area which then expands by the loss of carbonation pressure to its original cross-sectional area when the carbonation pressure is removed by opening the beverage container opening means. The figure shows the compressible plug member remaining in a smaller cross-sectional area configuration permitting the passage of humidification liquid and dry gas around it.
Figure 6:
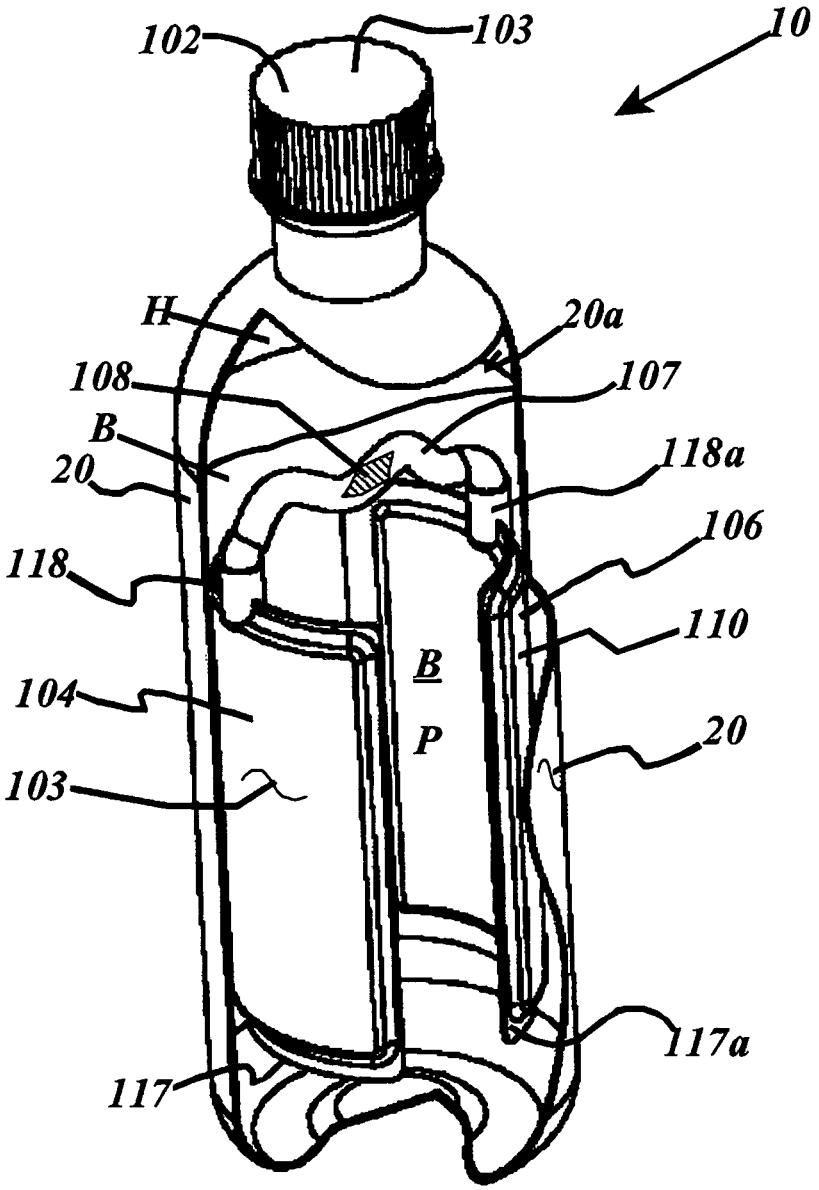
FIG. 6 shows the invention according to a first embodiment in use with a beverage container in the form of a bottle. The cooling assembly of the humidification liquid chamber, the dry gas chamber and the interconnection structure are shown inserted through the neck of the bottle. The apparatus functions in the same manner as in the first embodiment of the present invention.

Upon opening the beverage container opening means 103, the change in the container 20's internal carbonation pressure P to atmospheric pressure, causes the interconnection structure 107 to substantially expand preferably back to its original state, leaving the compressed compressible plug member 108 at a smaller cross-sectional area. The difference in dimensions between the final compressed state of the compressible plug member 108 and the starting uncompressed state of the compressible plug member 108 forms a gap that permits fluid communication between the dry gas chamber 106 and the humidification liquid chamber 104. The stages of compression and area reductions are shown in FIG. 5. Dry gas DG absorbs humidification liquid HL forming a vacuum and pulling humidification liquid HL into the dry gas chamber 106. The humidification liquid chamber 104 collapses to accommodate its new volume. Some humidification liquid HL vapor is evaporated during this process as well. The endothermically reacting chemical compounds R react with the humidification liquid HL and dissolve endothermically to cool the beverage product. The solvation causes a further reduction in volume of the humidification liquid chamber 104 and this causes the walls of the humidification liquid chamber 104 and the walls of the dry gas chamber 106 to collapse to permit more humidification liquid HL and humidification liquid HL vapor to be pulled into the dry gas chamber 106. Thus a complete dissolving of the endothermically reacting chemical compounds R occurs and cooling of the beverage product occurs and the entire cooling occurs in contact with the maximum area available in both chamber throughout the cooling process. It is important that the surface areas of the humidification liquid chamber 104 and the dry gas chamber 106 be respectively maximized for best cooling. As such, the apparatus 10 of this embodiment can be constructed using metallized bags connected by the interconnection structure 107 as described above and as shown in the figures.

Method of Manufacture of the Second Embodiment of the Present Invention

Figure 10:
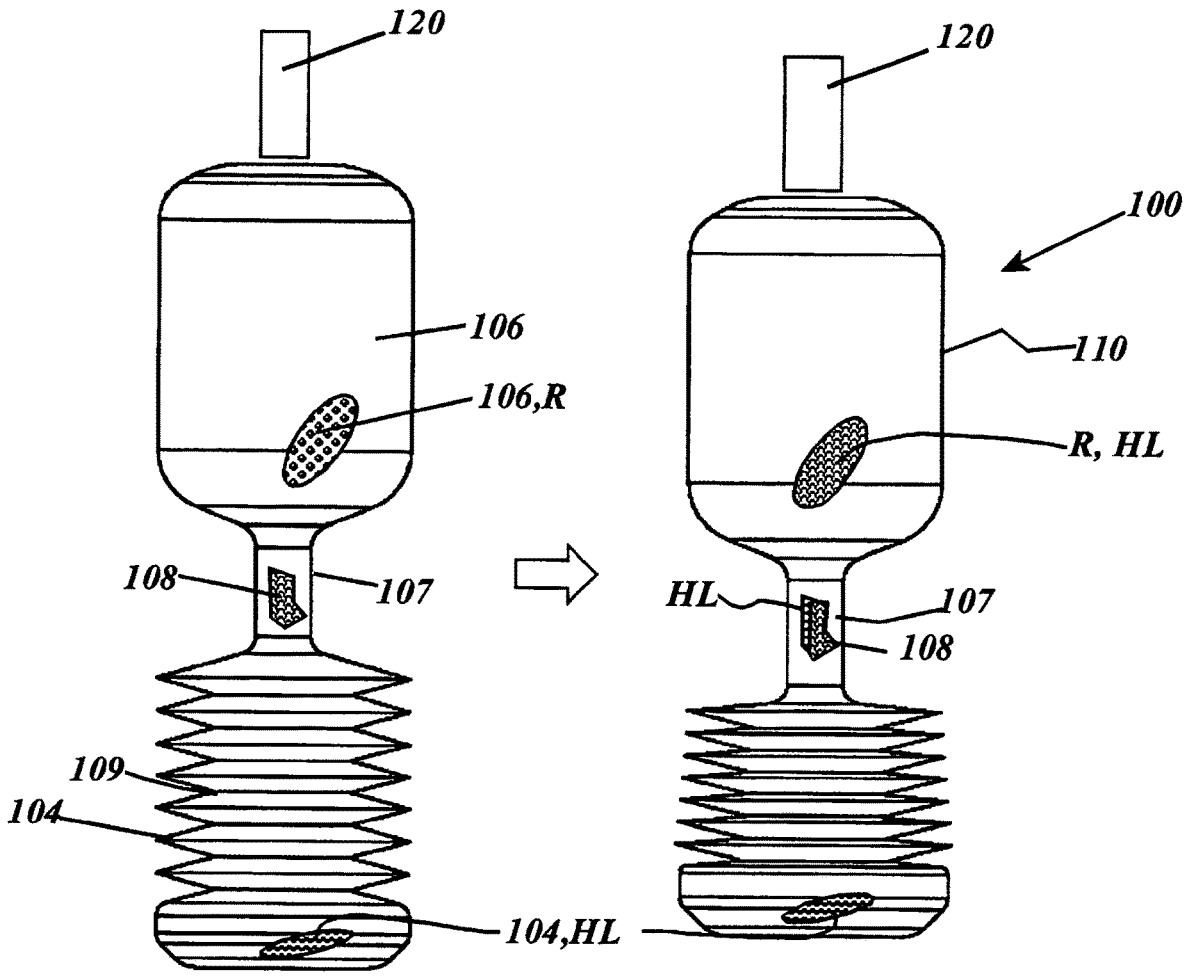
FIG. 10 shows the second embodiment of the invention without the beverage container with a rigid dry gas chamber and a flexible bellow acting as the humidification liquid chamber. The figure shows two stages of before and after activation of the cooling. The diagram to the left of the figure shows the dry gas chamber with dry gas saturating the endothermically reacting chemical compounds before actuation of the apparatus with the bellow in an extended configuration filled with humidification liquid. The diagram to the right of the figure shows a gap formed between the interconnection structure and the compressible plug member that permits the bellow to contract by a vacuum generated by dry gas pulling the humidification liquid into the dry gas chamber for cooling. It is anticipated that the bellow can also assist in the pulling of the humidification liquid into the dry gas chamber by means of its elastic and spring-like properties.

A second embodiment of the invention is shown in FIG. 10. In one preferred method of manufacture of the second embodiment, a humidification liquid chamber 104, a dry gas chamber 106 and an interconnection structure 107 are provided in the form of an injection-stretch-blown thin-walled plastic container. A plastic preform is made by conventional injection molding and then stretch-blown by conventional blow molding, to form the cooling assembly 100. The preform is blown to take the shape of a bottle to define the dry gas chamber 106 and to define the interconnection structure 107 as a narrow neck connecting to a bellows-shaped chamber that defines the humidification liquid chamber 104, as shown in FIG. 10.

The first step in forming a cooling assembly 100 of the present invention is to prepare a preform to form the two chambers and the interconnection structure 107 as a single or multiple stretch-blown plastic pieces, preferably as thin-walled structures with flexible walls. The humidification liquid chamber 104 is preferably a bellows-shaped structure, while the dry gas chamber 106 is preferably a cylindrically-shaped structure, and the interconnection structure 107 is preferably a small tube connecting the two chambers respectively. Preferably, a plastic material such as one of PET, PVC, Polyethylene, and Polycarbonate, is used for this example. The material used preferably is made from substantially impervious plastic materials that prevent to a great extent beverage and carbonation from passing through its walls.

The second step in the making of the cooling assembly 100 of the apparatus 10 is to fill the humidification liquid chamber 104 (the bellows) with humidification liquid HL through the blow spout 120. The humidification liquid HL must be chosen to react endothermically with the endothermically reacting chemical compounds R and to also evaporate when subjected to the dry gas DG. Preferably, the humidification liquid HL is water. Of course while the surface area of the dry gas chamber 106 is preferably substantially fixed as a cylinder, the volume of the humidification liquid chamber 104 depends on the extent to which its bellows shape can be expanded and contracted. Advantageously, any volume between the maximum expanded volume of the humidification liquid chamber 104 and the minimum possible contracted volume of the bellows can be accommodated.

The third step in making cooling assembly 100, according to the second embodiment of the invention, is to fill the interconnection structure 107 between the humidification liquid chamber 104 and the dry gas chamber 106 with a compressible plug member 108. The compressible plug member 108 is preferably made from a suitable deformable material, one of non-resilient and only partially resilient material such as a non-water-soluble wax, a rubber, cork, closed foam, a plastic, and a putty. The compressible plug member 108 is passed through the blow spout 120 and placed to sealingly fill either a portion or the entire interconnection structure 107 to separate the dry gas chamber 106 from the humidification liquid chamber 104. The compressible plug member 108 also can be made as a deformable metal disc and as a deformable metal cylinder such that it irreversibly or only partially reversibly deforms in cross-sectional area under beverage carbonation pressure, P. Thus, the compressible plug member 108 fluidly seals and separates the humidification liquid chamber 104 from the dry gas chamber 106. The interconnection structure 107 sealingly connects to the dry gas chamber 106 and to the humidification liquid chamber 104. The compressible plug member 108, if made from a wax, can be simply melted and poured to fill the interconnection structure 107. Since a wax floats on water, for example, it is possible to fill the water in the humidification liquid chamber 104 up to the start of the interconnection structure 107 and then pour molten wax to float above the humidification liquid HL and fill the interconnection structure 107.

The next step in manufacturing the apparatus 10 according to the second embodiment is filling the dry gas chamber 106 with granular forms of the endothermically reacting chemical compounds R through its open unsealed blow spout 120. The endothermically reacting chemical compounds R should be made to fill and contact the maximum possible surface area of the dry gas chamber walls 109.

Figure 11:
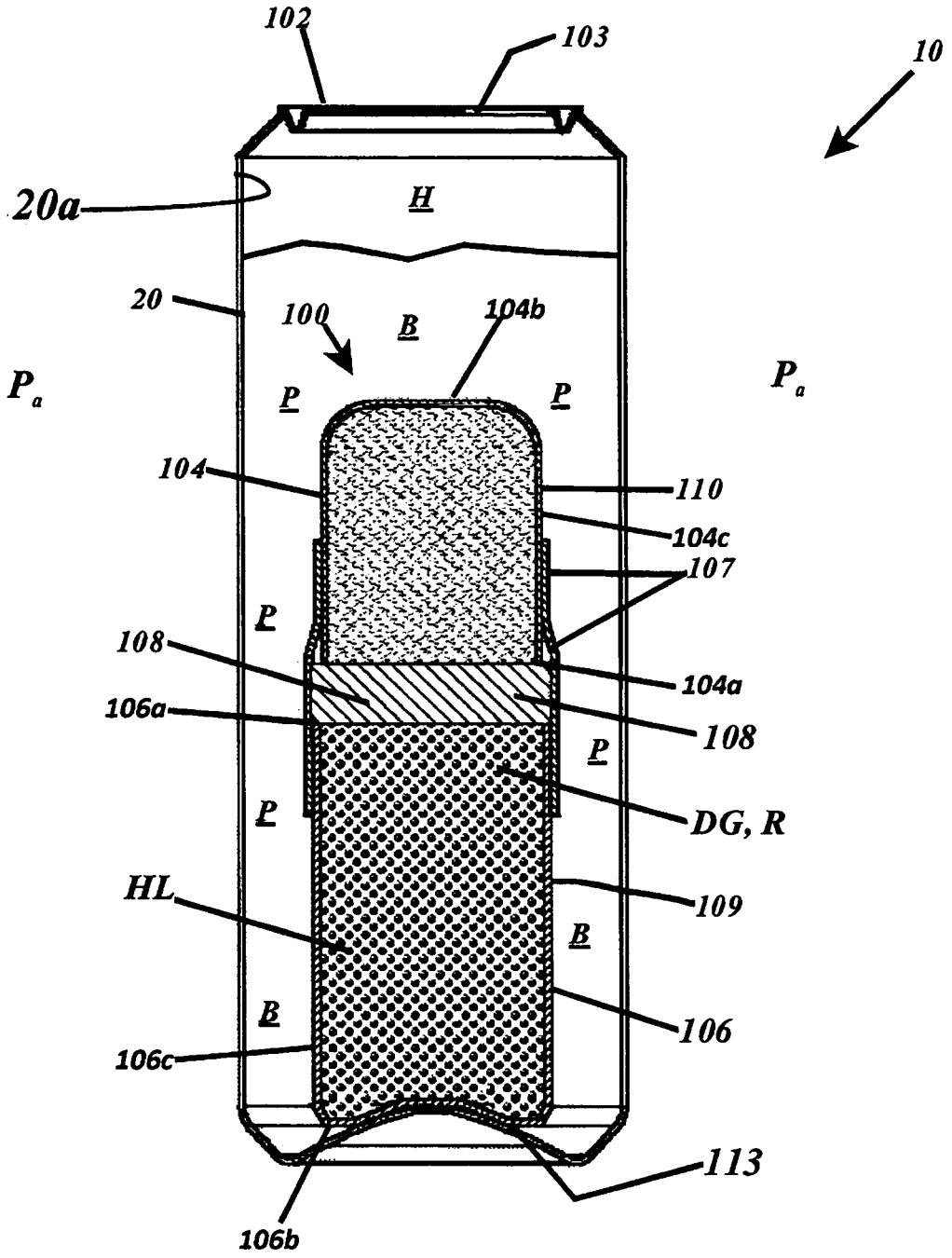
FIG. 11 shows the invention according to a third embodiment just as the beverage container is sealed before carbonation pressure builds up. A cross-section of the apparatus is shown and the dry gas chamber and the humidification liquid chamber are shown as made from open ended cylindrical containers that slide over each other. Note that the interconnection structure is configured as a tube sleeve that seals the dry gas chamber and the humidification liquid chamber and the two chambers are separated by the compressible plug member. Thus the humidification liquid chamber and the dry gas chambers can be made with open-ended metal or plastic cylindrical containers connected by the interconnection structure and made to slide into each other.

The next step is to flood the dry gas chamber 106 through the blow spout 120, with a substantially dry gas DG, preferably one of $CO_2$, dimethyl ether (DME), and one or combinations of DME, $CO_2$, Solstice® L41 y (R-452B), Solstice® 452A (R-452A), Solstice® L40X (R-455A), Solstice® zd, Solstice® ze, (R-1234ze), and Solstice® yf (R-1234yf). The dry gas DG is filled by simply blowing it at a low flow rate through blow spout 120 into the granules of the endothermically reacting chemical compounds R to replace any air that fills the interstitial spaces between the granules of the endothermically reacting chemical compounds R. The next step is to thermally seal the dry gas chamber 106 by heat sealing the open end of the blow spout 120 to form a closed dry gas chamber 106 and to form the completed cooling assembly 100, as shown in FIG. 11.

A standard beverage container 20 preferably is provided in the form of a conventional metal can or in the form of a plastic bottle. The cooling assembly 100, comprising the humidification liquid chamber 104, the dry gas chamber 106 and the interconnection structure 107 with the compressible plug member 108 separating the two, is then inserted into the beverage container 20. Carbonated beverage B is then filled into the beverage container 20 by conventional means. A beverage container lid 102 with a beverage container opening means 103 is provided for sealing off the beverage container 20 with the cooling assembly 100 inside to form the apparatus 10 according to the second embodiment.

When the beverage container 20 is sealed off by the beverage container lid 102, carbonation pressure P builds up. The carbonation pressure P of the beverage compresses the humidification liquid chamber 104 and the dry gas chamber 106 and the interconnection structure 107 until the internal pressure of the humidification liquid chamber 104 and the internal pressure dry gas chamber 106 and the internal pressure of the interconnection structure equal the carbonation pressure P. The carbonation pressure P also deforms the interconnection structure 107 and compresses the interconnection structure 107 and the compressible plug member 108 to a substantially smaller cross-sectional area than its starting cross-sectional area, while the compressible plug member 108 still remains in a sealing configuration. The apparatus 10 is now ready for use.

Method of Operation of the Second Embodiment of the Invention

Upon opening the beverage container opening means 103, the change in internal pressure within the beverage container 20, from carbonation pressure P to atmospheric pressure $P_a$, causes the interconnection structure 107 to substantially expand back preferably to its cross-sectional area, leaving the compressed compressible plug member 108 at the smaller cross-sectional area than the expanded cross-sectional area of the interconnection structure 107. The difference in dimensions between the final compressed state of the compressible plug member 108 and the starting uncompressed state of the compressible plug member 108 forms a gap that permits fluid communication between the dry gas chamber 106 and the humidification liquid chamber 104. The stages of compression and area reductions are shown in FIG. 5. Dry gas DG absorbs humidification liquid HL, forming a vacuum and pulling humidification liquid HL into the dry gas chamber 106. The humidification liquid chamber 104 collapses by the contraction of the bellows to accommodate its new volume. Some humidification liquid HL vapor is evaporated during this process as well. The endothermically reacting chemical compounds R react with the humidification liquid HL and dissolve endothermically to cool the beverage product. The solvation causes a further reduction in volume of the humidification liquid chamber 104 and this causes the walls of the humidification liquid chamber 104 to further collapse to permit more humidification liquid HL and humidification liquid HL vapor to be pulled into the dry gas chamber 106. Thus a complete dissolving of the endothermically reacting chemical compounds R occurs and cooling of the beverage B product occurs, and the entire cooling occurs in contact with the maximum area available in both chambers throughout the cooling process. It is important that the surface areas of the humidification liquid chamber 104 and the dry gas chamber 106 be respectively maximized for best cooling. As such, the apparatus 10 of this embodiment can be constructed using metallized plastic bags materials, and thin aluminum foil materials, connected by the interconnection structure 107, as described above and as shown in the figures. It is also important to note that a compression tension of the humidification liquid chamber 104 can be built into the bellows if the bellows is made in a minimal volume configuration and then expanded to fill the humidification liquid HL in it. Then, upon activation, the tension of the expanded bellows can push humidification liquid HL into the dry gas chamber 106 as well.

Method of Manufacture of the Third Embodiment of the Present Invention

Figure 12:
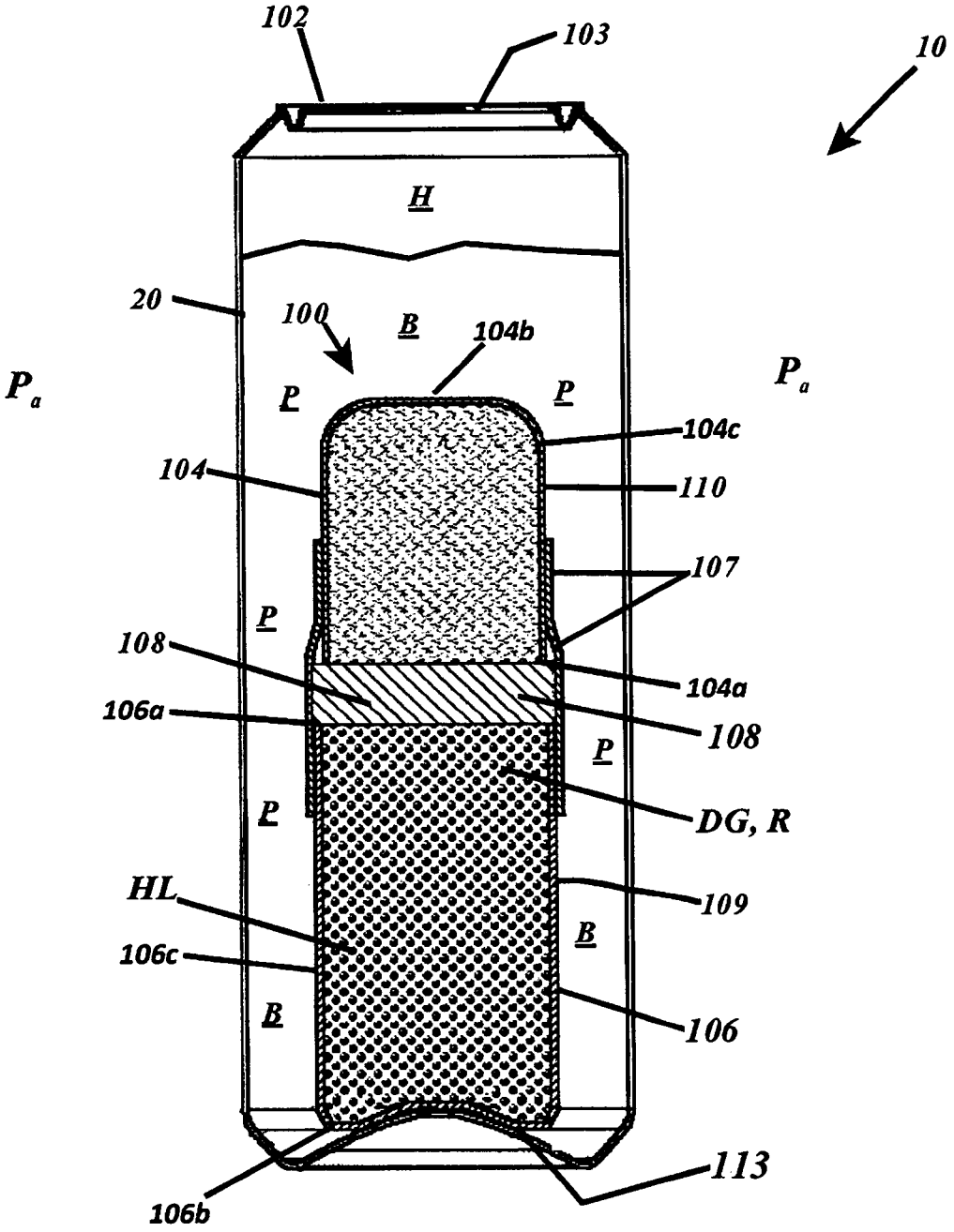
FIG. 12 shows the invention according to a third embodiment prior to carbonation pressure build up in the beverage container pressure. Subsequent to carbonation pressure build up, the carbonation pressure compresses the interconnection structure to compress the compressible plug member and reduce its cross sectional area while keeping it in a sealing configuration.
Figure 13:
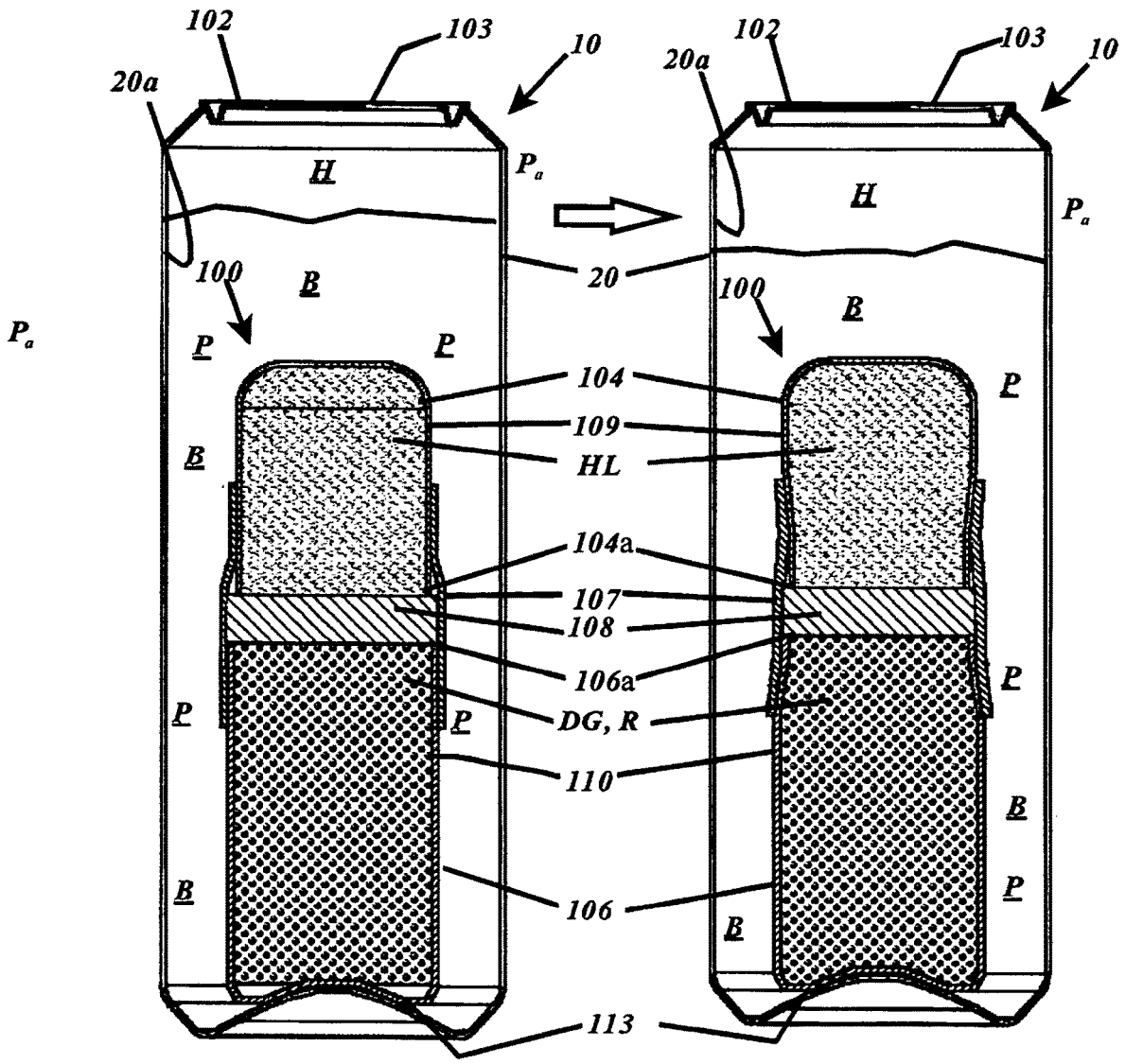
FIG. 13 shows the two stages of the apparatus before and after the beverage container is opened for consumption. The left side of the drawing shows the compressed compressible plug member before opening the beverage container for consumption. The figure to the right shows the state of the apparatus after the beverage container opening means is activated. The loss of pressure releases the compression of the interconnection structure and leaves the compressible plug member in the smaller cross-sectional area configuration. This permits dry gas and humidification liquid to interact and the dry gas can pass around the shrunk compressible plug member to permit humidification liquid to be sucked up by the dry gas to generate a vacuum. The vacuum then pulls and slides the humidification liquid chamber into the dry gas chamber and shrinks the total volume of the two chambers to permit the endothermically reacting chemical compounds to react intimately without leaving any free unused interstitial spaces.
Figure 13A:
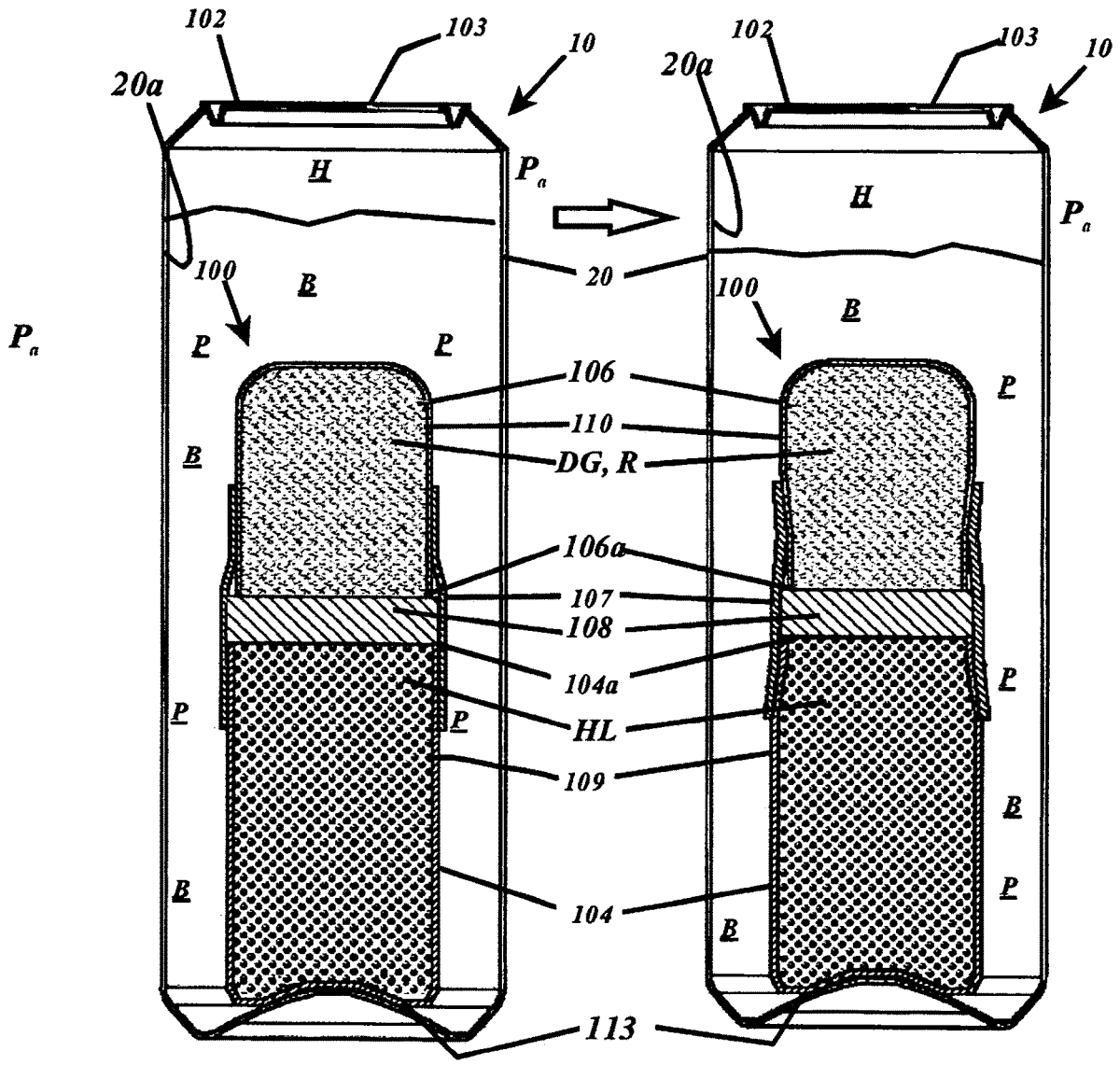
FIG. 13*a* shows the two stages of the apparatus before and after the beverage container is opened for consumption with the dry gas chamber smaller than the humidification liquid chamber. The left side of the drawing shows the compressed compressible plug member before opening the beverage container for consumption. The figure to the right shows the state of the apparatus after the beverage container opening means is activated. The loss of pressure releases the compression of the interconnection structure and leaves the compressible plug member in the smaller cross-sectional area configuration. This permits dry gas and humidification liquid to interact and the dry gas can pass around the shrunk compressible plug member to permit humidification liquid to be sucked up by the dry gas to generate a vacuum. The vacuum then pulls and slides the dry gas chamber into the humidification chamber and shrinks the total volume of the two chambers to permit the endothermically reacting chemical compounds to react intimately without leaving any free unused interstitial spaces.

A third embodiment of the invention is shown in FIG. 11-13. In this embodiment of the invention, the same elements used in the first embodiment are used to reconfigure another embodiment of the invention that uses telescoping cylindrical chambers instead of collapsible flexible chambers. A standard beverage container 20 is provided with a beverage lid 102 and a beverage opening means 103 containing a beverage B that is carbonated and under pressure P. The beverage container 20 may be a metal container of standard conventional form or a plastic bottle of conventional form. The humidification liquid chamber 104 and the dry gas chamber 106 with their respective contents therein, form a cooling assembly 100 provided within the sealed beverage container 20 as described hereunder.

A thin cylindrical-walled humidification liquid chamber 104 is provided. Humidification liquid chamber 104 is configured as a cylindrical cup with a tubular cup side wall 104*c* with a cup open end 104*a* and a cup end wall 104*b* opposing the cup open end 104*a*. Humidification liquid HL such as water is held within the humidification liquid chamber 104 and a compressible plug member 108 preferably made from a suitable irreversibly deformable material which is one of non-resilient and only partially resilient material such as deformable wax, rubber, and plastic, is placed to seal off the humidification liquid chamber 104 open end and fluidly isolate the humidification liquid chamber 104. This can easily be achieved by filling the humidification liquid chamber 104 with water for example, heating the water, and melting a suitable wax over the water surface to form a wax sealing layer. When the wax dries, it forms a hermetic seal over the humidification liquid HL and seals off the open end of the humidification liquid chamber 104.

Similarly, a dry gas chamber 106 is provided comprising a thin cylindrical-walled container having a tubular cup side wall 106*c* with a cup open end 106*a* and a cup end wall 106*b* opposing the cup open end 106*a*. The dry gas chamber 106 contains crystalline forms of endothermically reacting chemical compounds R such as potassium nitrate, potassium chloride and urea. Dry gas DG is flowed into the dry gas chamber 106 to fill the interstitial spaces between the crystals of the endothermically reacting chemical compounds R. When the humidification chamber 104 is slid into the dry gas chamber 106, the interconnection structure 107 is placed over the assembly not only to hold the two chambers in place and to snugly and frictionally and sealingly connect them but also to prevent them from sliding apart. Alternatively, compressible plug member 108 may be filled into the interconnection structure 107 to abut and seal against the interconnection structure 107, to separate the dry gas chamber 106 and the humidification liquid chamber 104.

It is also important that the dry gas DG be chilled to a temperature to prevent fast pressure build up that can drive apart and separate the two chambers before the beverage container 20 is sealed off with the beverage container lid 102. The internal pressure of the dry gas DG will build up until it also equilibrates with the beverage carbonation pressure P. As such, the pressure of the dry gas DG as it heats up to room temperature and gasifies cannot exceed the carbonation pressure P. The carbonation pressure P compresses the interconnection structure 107, and this compresses the compressible plug member 108 to a smaller diameter than its starting diameter while remaining in a sealing configuration.

The interconnection structure 107 preferably is made in the form of one of a plastic sleeve and a rubber sleeve, to tightly and slidingly seal off the open ends of the dry gas chamber 106 and the humidification liquid chamber 104. The dry gas chamber open end 106*a* is made to snugly and sealingly slide over the side wall and the end wall of the humidification liquid chamber wall 110. Thus, when the humidification liquid chamber 104 is sealingly slid into the dry gas chamber 106, the reduced combined volume of the two chambers will substantially and preferably be made to equal to the volume of the dry gas chamber 106 only. The entire cooling assembly 100 can be left to just float inside the beverage container 20 in the beverage B, and alternatively the cooling assembly 100 also may be affixed to the beverage container inner wall 20*a* at any place or orientation.

When the beverage container 20 is filled and sealed off as before by the beverage container lid 102, carbonation pressure P builds up internally within the beverage container 20. The carbonation pressure P compresses the interconnection structure 107, which compresses around the compressible plug member 108 until the internal pressure of the humidification liquid chamber 104 and the dry gas chamber 106 equals the carbonation pressure P. The cross-sectional area of the compressible plug member 108 in turn reduces due to carbonation pressure P compression.

Method of Use of the Third Embodiment of the Present Invention

Upon opening the beverage container opening means 103, the change in container 20's internal carbonation pressure P to atmospheric pressure $P_a$, causes the interconnection structure 107 to relax its pressure compression grip that is transmitted to the compressible plug member 108. The compressible plug member 108 remains in a deformed smaller cross-section and the difference in dimensions between the final compressed state of the compressible plug member 108 and the uncompressed state of the compressible plug member 108 permits fluid communication between the dry gas chamber 106 and the humidification liquid chamber 104, and the and the dry gas DG starts to absorb humidification liquid HL forming a vacuum V and pulling humidification liquid HL into the dry gas chamber 106. The humidification liquid chamber 104 is pulled further into the dry gas chamber 106 by the generated vacuum. Some humidification liquid HL vapor is evaporated during this process as well. The endothermically reacting chemical compounds R react with the humidification liquid HL and dissolve endothermically to cool the beverage B. The solvation causes a further reduction in volume of the dry gas chamber 106 and this causes more humidification liquid HL and humidification liquid vapor to be pulled into the dry gas chamber 106. Thus a complete dissolving of the endothermically reacting chemical compounds R occurs and cooling of the beverage B occurs. It is important that the surface areas of the humidification liquid chamber 104 and dry gas chamber 106 be maximized for best cooling.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A cooling apparatus, comprising:

a container having a container wall and being surrounded by atmospheric pressure;

a first chamber containing granulated endothermic chemicals with interstitial spaces filled with a dry gas having a dew point temperature range 10° F. to −150° F. for a humidification liquid at said A DRY GAS pressure greater than atmospheric pressure; and a second chamber within said container and being filled with said humidification liquid that is removed from said dry gas at said dew point temperature range; separated from said first chamber by a barrier material insoluble in said humidification liquid, an interconnection structure interconnecting said first chamber and said second chamber, said interconnection structure containing barrier material insoluble in said humidification liquid and internally abutting and initially sealing said interconnection structure;

such that when said container is opened and said container interior is exposed to atmospheric pressure, said dry gas pressure expands said interconnection structure collapsible wall away from said barrier material and exposes said humidification liquid vapor to said dry gas and said dry gas absorbs said humidification liquid vapor forming a vacuum within said second chamber; and said vacuum collapses said collapsible wall into a minimal volume by absorption of said humidification liquid in to said interstitial spaces causing a first cooling of said apparatus collapsible walls; and said endothermic compounds react with said humidification liquid to cause a second endothermic cooling of said apparatus collapsible walls and said first and second cooling cools any medium surrounding said collapsible walls.

2. The apparatus of claim 1, wherein said at least one endothermic reaction compound is a dry gas contained within said first chamber.

3. The apparatus of claim 2, wherein the endothermic reaction compound comprises at least one of potassium nitrate, potassium chloride and urea.

4. The apparatus of claim 1, wherein said barrier material comprises a plastic material.

5. The apparatus of claim 1, wherein said medium surrounding said collapsible walls is a beverage.

6. The apparatus of claim 1, wherein said humidification liquid comprises dimethylether.

7. The apparatus of claim 1, wherein said humidification liquid comprises SOLSTICE™ L41y (R-452B), SOLSTICE™ 452A (R-452A), SOLSTICE™ L40X (R-455A), SOLSTICE™ zd, SOLSTICE™ ze (R-1234ze), SOLSTICE™ yf (R-1234YF).

8. A self-cooling beverage container apparatus, comprising:

a beverage container surrounded by atmospheric pressure and having a container wall and a container opening mechanism and a carbonated beverage contained within said container and producing a carbonation pressure which increases container internal pressure above atmospheric pressure subsequent to assembly of said container, filling of said container with said carbonated beverage and sealing of said container;

a cooling assembly at least partly submerged in said carbonated beverage and comprising a cooling assembly vessel with a collapsible volume and having a vessel wall and a vessel first region and a vessel second region; a compressible plug member formed of a plug member material which lacks resilience to return to its initial cross-section area after being compressed and has a plug member initial cross-sectional area when said container is sealed and is contained within said vessel and abuts a plug member abutment portion of said vessel wall which is compressible and has resilience to return at least partly to its initial cross-sectional area after having been compressed and said plug member abutment portion defining an interconnection structure comprising said plug abutment portion, separating said vessel into said first vessel first region defining a humidification liquid chamber having a humidification liquid chamber wall and a humidification liquid contained within said humidification liquid chamber and the vessel second region defining a dry gas chamber having a dry gas chamber wall, and at least one endothermic reaction compound contained within said dry gas chamber, wherein said interconnection structure fluidly interconnects said humidification liquid chamber and said dry gas chamber;

said plug member abutment portion having a plug member abutment portion initial cross-sectional area and the interconnection structure having an interconnection structure initial cross-sectional area at atmospheric pressure prior to container assembly and sealing, and being compressed to a plug member abutment portion compressed cross-sectional area by a subsequent increase in container internal pressure to carbonation pressure subsequent to container assembly and sealing which is less than the interconnection structure initial cross-sectional area, thereby compressing the plug member initial cross-sectional area to a plug member compressed cross-sectional area, such that the plug member compressed cross-sectional area and shape matches the plug member abutment portion compressed cross-sectional area and shape and circumferentially abuts said plug member abutment portion, thereby maintaining its sealing of said interconnection structure against the passage of fluid;

such that operating said container opening mechanism and thereby opening said container to the surrounding atmosphere causes a decrease in the container internal pressure bearing upon said plug member abutment portion from the carbonation pressure to atmospheric pressure, permitting said plug member abutment portion to resiliently expand relative to said plug member to a plug member abutment portion expanded cross-sectional area, creating space between said plug member and said plug member abutment portion and thereby opening fluid communication between said humidification liquid chamber and said dry gas chamber through said interconnection structure, causing said humidification liquid to mix and react with said at least one endothermic reaction compound endothermically, extracting heat from said beverage, and thereby cooling said beverage.

9. The apparatus of claim 1, wherein said at least one endothermic reaction compound is a dry gas contained within said first chamber.

10. The apparatus of claim 1, wherein said medium surrounding said collapsible walls is a beverage.

11. A cooling apparatus with a collapsible walls subjected to a pressure greater than atmospheric pressure and forming a first chamber and a second chamber within said apparatus; said first chamber containing granulated endothermic chemicals with interstitial spaces filled with a dry gas having a dew point temperature range 10° F. to −150° F. fora humidification liquid at said pressure greater than atmospheric pressure; said second chamber separated from said first chamber by a barrier material insoluble in said humidification liquid; said second chamber filled with said humidification liquid that is removed from said dry gas at said dew point temperature range; such that when the apparatus is exposed to atmospheric pressure, said dry gas expands away from said barrier material and exposes said humidification liquid vapor to said dry gas and said dry gas absorbs said humidification liquid vapor forming a vacuum with said apparatus; and said vacuum collapses said collapsible walls into a minimal volume by absorption of said humidification liquid in to said interstitial spaces causing a first cooling of said apparatus collapsible walls; and said endothermic compounds react with said humidification liquid to cause a second endothermic cooling of said apparatus collapsible walls and said first and second cooling cools any medium surrounding said collapsible walls.

* * * * *